US010424878B2

(12) United States Patent
Lloyd et al.

(10) Patent No.: US 10,424,878 B2
(45) Date of Patent: Sep. 24, 2019

(54) CABLE CONNECTOR ASSEMBLY

(71) Applicant: Molex, LLC, Lisle, IL (US)

(72) Inventors: Brian Keith Lloyd, Maumelle, AR (US); Gregory Fitzgerald, Merrimack, NH (US); Bruce Reed, Maumelle, AR (US); Gregory Walz, Maumelle, AR (US); Ayman Isaac, Little Rock, AR (US); Dino McLaughlin, Jr., Vilonia, AR (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/069,058

(22) PCT Filed: Jan. 11, 2017

(86) PCT No.: PCT/US2017/012988
§ 371 (c)(1),
(2) Date: Jul. 10, 2018

(87) PCT Pub. No.: WO2017/123614
PCT Pub. Date: Jul. 20, 2017

(65) Prior Publication Data

US 2019/0027870 A1 Jan. 24, 2019

Related U.S. Application Data

(60) Provisional application No. 62/277,230, filed on Jan. 11, 2016.

(51) Int. Cl.
*H01R 13/6581* (2011.01)
*H01R 4/02* (2006.01)
(Continued)

(52) U.S. Cl.
CPC ..... *H01R 13/6581* (2013.01); *H01R 4/023* (2013.01); *H01R 9/034* (2013.01);
(Continued)

(58) Field of Classification Search
CPC ..... H01R 4/02; H01R 4/021; H01R 4/023; H01R 4/029; H01R 9/032; H01R 9/034;
(Continued)

(56) References Cited

U.S. PATENT DOCUMENTS 3,007,131 A 10/1961 Dahlgren et al.
3,594,613 A 7/1971 Prietula
(Continued)

FOREIGN PATENT DOCUMENTS

CN 1316802 A 10/2001
CN 2624465 Y 7/2004
(Continued)

OTHER PUBLICATIONS

International Search Report and Written Opinion received for PCT application No. PCT/US2016/012848, dated Apr. 25, 2016, 11 pages.
(Continued)

*Primary Examiner* — Vanessa Girardi
(74) *Attorney, Agent, or Firm* — Molex, LLC

(57) ABSTRACT

A cable connector for use in a bypass assembly is disclosed. Twin-ax cables are directly terminated to the cable connector. The cable connector includes a sub-connector that includes terminals that have termination portions extending outwardly and signal conductors from the bypass cables are aligned with the termination portions and welded together. A carrier and ground collar can help connect termination portions that are intended for ground terminals together to form commoned ground terminals.

14 Claims, 32 Drawing Sheets

(51) Int. Cl.

| | |
|---|---|
| ***H01R 9/03*** | (2006.01) |
| ***H01R 12/71*** | (2011.01) |
| ***H01R 12/77*** | (2011.01) |
| ***H01R 12/79*** | (2011.01) |

(52) U.S. Cl.
CPC ..... *H01R 12/716* (2013.01); *H01R 12/775* (2013.01); *H01R 12/79* (2013.01)

(58) Field of Classification Search
CPC ..... H01R 12/70; H01R 12/71; H01R 13/00; H01R 13/02; H01R 13/40; H01R 13/405; H01R 13/648; H01R 13/658; H01R 13/6581; H01R 13/6591
See application file for complete search history.

(56) References Cited

U.S. PATENT DOCUMENTS 3,963,319 A 6/1976 Schumacher et al.
4,025,141 A 5/1977 Thelissen
4,072,387 A 2/1978 Sochor
4,083,615 A 4/1978 Volinskie
4,157,612 A 6/1979 Rainal
4,290,664 A 9/1981 Davis et al.
4,307,926 A 12/1981 Smith
4,346,355 A 8/1982 Tsukii
4,417,779 A 11/1983 Wilson
4,508,403 A 4/1985 Weltman
4,611,186 A 9/1986 Ziegner
4,615,578 A 10/1986 Stadler
4,639,054 A 1/1987 Kersbergen
4,656,441 A 4/1987 Takahashi et al.
4,657,329 A 4/1987 Dechelette
4,679,321 A 7/1987 Plonski
4,697,862 A 10/1987 Hasircoglu
4,724,409 A 2/1988 Lehman
4,889,500 A 12/1989 Lazar
4,924,179 A 5/1990 Sherman
4,948,379 A 8/1990 Evans
4,984,992 A 1/1991 Beamenderfer et al.
4,991,001 A 2/1991 Takubo et al.
5,112,251 A 5/1992 Cesar
5,197,893 A 3/1993 Morlion et al.
5,332,979 A 7/1994 Roskewitsch
5,387,130 A 2/1995 Fedder et al.
5,402,088 A 3/1995 Pierro et al.
5,435,757 A 7/1995 Fedder et al.
5,441,424 A 8/1995 Morlion et al.
5,487,673 A 1/1996 Hurtarte
5,509,827 A 4/1996 Huppenthal et al.
5,554,038 A 9/1996 Morlion et al.
5,598,627 A 2/1997 Saka et al.
5,632,634 A 5/1997 Soes
5,691,506 A 11/1997 Miyazaki et al.
5,781,759 A 7/1998 Kashiwabara
5,876,239 A 3/1999 Morin et al.
6,004,139 A 12/1999 Dramstad
6,053,770 A 4/2000 Blom
6,083,046 A 7/2000 Wu et al.
6,095,872 A 8/2000 Lang et al.
6,139,372 A * 10/2000 Yang ..... G06F 1/189 439/660
6,144,559 A 11/2000 Johnson et al.
6,156,981 A 12/2000 Ward et al.
6,203,376 B1 3/2001 Magajne et al.
6,255,741 B1 7/2001 Yoshihara
6,266,712 B1 7/2001 Henrichs
6,273,753 B1 8/2001 Ko
6,273,758 B1 8/2001 Lloyd
6,366,471 B1 4/2002 Edwards et al.
6,368,120 B1 4/2002 Scherer
6,371,788 B1 4/2002 Bowling et al.
6,452,789 B1 9/2002 Pallotti et al.
6,489,563 B1 12/2002 Zhao et al.
6,535,367 B1 3/2003 Carpenter
6,574,115 B2 6/2003 Asano et al.
6,575,772 B1 6/2003 Soubh et al.
6,592,401 B1 7/2003 Gardner et al.
6,652,296 B2 11/2003 Kuroda et al.
6,652,318 B1 11/2003 Winings et al.
6,685,501 B1 2/2004 Wu et al.
6,692,262 B1 2/2004 Loveless
6,705,893 B1 3/2004 Ko
6,764,342 B2 * 7/2004 Murayama ..... H01R 4/023 439/607.1
6,780,069 B2 8/2004 Scherer
6,797,891 B1 9/2004 Blair et al.
6,824,426 B1 11/2004 Spink, Jr.
6,843,657 B2 1/2005 Driscoll et al.
6,882,241 B2 4/2005 Abo et al.
6,903,934 B2 6/2005 Lo
6,910,914 B1 6/2005 Spink, Jr.
6,916,183 B2 7/2005 Alger et al.
6,955,565 B2 10/2005 Lloyd
6,969,270 B2 11/2005 Renfro
6,969,280 B2 11/2005 Chien
6,971,887 B1 12/2005 Trobough
7,004,765 B2 2/2006 Hsu
7,004,793 B2 2/2006 Scherer
7,040,918 B2 * 5/2006 Moriyama ..... H01R 13/5045 439/497
7,044,772 B2 5/2006 McCreery
7,052,292 B2 5/2006 Hsu et al.
7,056,128 B2 6/2006 Driscoll et al.
7,066,756 B2 6/2006 Lange et al.
7,070,446 B2 7/2006 Henry
7,108,522 B2 9/2006 Verelst et al.
7,148,428 B2 12/2006 Meier et al.
7,168,961 B2 1/2007 Hsieh
7,175,446 B2 2/2007 Bright
7,192,300 B2 3/2007 Hashiguchi et al.
7,214,097 B1 5/2007 Hsu et al.
7,223,915 B2 5/2007 Hackman
7,234,944 B2 6/2007 Nordin
7,244,137 B2 7/2007 Renfro et al.
7,280,372 B2 10/2007 Grundy et al.
7,307,293 B2 12/2007 Fjelstad et al.
7,331,816 B2 2/2008 Krohn et al.
7,384,275 B2 6/2008 Ngo
7,394,665 B2 7/2008 Hamasaki et al.
7,402,048 B2 7/2008 Meier et al.
7,431,608 B2 10/2008 Sakaguchi et al.
7,445,471 B1 11/2008 Scherer et al.
7,462,924 B2 12/2008 Shuey
7,489,514 B2 2/2009 Hamasaki
7,534,142 B2 5/2009 Avery
7,540,773 B2 6/2009 Ko
7,549,897 B2 6/2009 Fedder et al.
7,621,779 B2 11/2009 Laurx et al.
7,637,767 B2 12/2009 Davis
7,654,831 B1 2/2010 Wu
7,658,654 B2 2/2010 Ohyama
7,690,930 B2 4/2010 Chen et al.
7,719,843 B2 5/2010 Dunham
7,744,385 B2 6/2010 Scherer
7,744,403 B2 6/2010 Barr
7,744,414 B2 6/2010 Scherer et al.
7,748,988 B2 7/2010 Hori
7,771,207 B2 8/2010 Hamner et al.
7,789,529 B2 9/2010 Roberts
7,819,675 B2 10/2010 Ko et al.
7,824,197 B1 11/2010 Westman
7,857,629 B2 12/2010 Chin
7,857,630 B2 12/2010 Hermant et al.
7,862,344 B2 1/2011 Morgan
7,892,019 B2 2/2011 Rao
7,906,730 B2 3/2011 Atkinson et al.
7,931,502 B2 4/2011 Iida
7,985,097 B2 7/2011 Gulla
7,997,933 B2 8/2011 Feldman
8,002,583 B2 8/2011 van Woensel
8,018,733 B2 9/2011 Jia
8,036,500 B2 10/2011 McColloch
8,157,573 B2 4/2012 Tanaka

(56) References Cited

U.S. PATENT DOCUMENTS 8,162,675 B2 4/2012 Regnier
8,187,038 B2 5/2012 Kamiya
8,192,222 B2 6/2012 Kameyama
8,226,441 B2 7/2012 Regnier
8,308,491 B2 11/2012 Nichols et al.
8,337,243 B2 12/2012 Elkhatib et al.
8,338,713 B2 12/2012 Fjelstad et al.
8,398,433 B1 3/2013 Yang
8,419,472 B1 4/2013 Swanger
8,435,074 B1 5/2013 Grant
8,439,704 B2 5/2013 Reed
8,449,312 B2 5/2013 Lan
8,449,330 B1 5/2013 Schroll
8,465,302 B2 6/2013 Regnier
8,480,413 B2 7/2013 Minich
8,517,765 B2 8/2013 Schroll
8,535,069 B2 9/2013 Zhang
8,540,525 B2 9/2013 Regnier
8,575,529 B2 9/2013 Asahi
8,553,102 B2 10/2013 Yamada
8,575,491 B2 11/2013 Gundel
8,588,561 B2 11/2013 Zbinden
8,597,055 B2 12/2013 Regnier
8,651,890 B2 2/2014 Chiarelli
8,672,707 B2 3/2014 Nichols et al.
8,690,604 B2 4/2014 Davis
8,715,003 B2 5/2014 Buck
8,721,361 B2 * 5/2014 Wu ..... H01R 13/405 439/497
8,740,644 B2 6/2014 Long
8,747,158 B2 6/2014 Szczesny
8,753,145 B2 6/2014 Lang
8,758,051 B2 6/2014 Nonen et al.
8,764,483 B2 7/2014 Ellison
8,784,122 B2 7/2014 Soubh
8,787,711 B2 7/2014 Zbinden
8,794,991 B2 8/2014 Ngo
8,804,342 B2 8/2014 Behziz et al.
8,814,595 B2 8/2014 Cohen et al.
8,834,190 B2 9/2014 Ngo
8,864,521 B2 10/2014 Atkinson et al.
8,888,533 B2 11/2014 Westman et al.
8,905,767 B2 12/2014 Putt, Jr. et al.
8,911,255 B2 12/2014 Scherer et al.
8,926,342 B2 1/2015 Vinther
8,926,377 B2 1/2015 Kirk
8,992,236 B2 3/2015 Wittig
8,992,237 B2 3/2015 Regnier
8,992,258 B2 3/2015 Raschilla
9,011,177 B2 4/2015 Lloyd
9,028,281 B2 5/2015 Kirk
9,035,183 B2 5/2015 Kodama et al.
9,040,824 B2 5/2015 Guetig et al.
9,054,432 B2 6/2015 Yang
9,071,001 B2 6/2015 Scherer et al.
9,119,292 B2 8/2015 Gundel
9,136,652 B2 9/2015 Ngo
9,142,921 B2 9/2015 Wanha et al.
9,155,214 B2 10/2015 Ritter
9,160,123 B1 10/2015 Pao
9,160,151 B2 10/2015 Vinther
9,161,463 B2 10/2015 Takamura
9,166,320 B1 * 10/2015 Herring ..... H01R 12/79
9,196,983 B2 11/2015 Saur et al.
9,203,171 B2 12/2015 Yu
9,209,539 B2 12/2015 Herring
9,214,756 B2 12/2015 Nishio
9,214,768 B2 12/2015 Pao
9,232,676 B2 1/2016 Sechrist et al.
9,246,251 B2 1/2016 Regnier
9,277,649 B2 3/2016 Ellison
9,312,618 B2 4/2016 Regnier
9,331,432 B1 5/2016 Phillips
9,350,108 B2 5/2016 Long
9,356,366 B2 5/2016 Moore
9,385,455 B2 7/2016 Regnier
9,391,407 B1 7/2016 Bucher
9,401,563 B2 7/2016 Simpson
9,413,090 B2 8/2016 Nagamine
9,413,097 B2 8/2016 Tamarkin et al.
9,413,112 B2 8/2016 Helster
9,431,773 B2 8/2016 Chen
9,437,981 B2 9/2016 Wu
9,455,538 B2 9/2016 Nishio
9,484,671 B2 11/2016 Zhu
9,484,673 B1 11/2016 Yang
9,490,587 B1 11/2016 Phillips
9,496,655 B1 11/2016 Huang
9,515,429 B2 12/2016 DeGeest
9,525,245 B2 12/2016 Regnier
9,543,688 B2 1/2017 Pao
9,553,381 B2 1/2017 Regnier
9,559,465 B2 1/2017 Phillips
9,565,780 B2 2/2017 Nishio
9,608,388 B2 3/2017 Kondo
9,608,590 B2 3/2017 Hamner
9,627,818 B1 4/2017 Chen
9,660,364 B2 5/2017 Wig et al.
9,666,998 B1 5/2017 deBoer
9,673,570 B2 6/2017 Briant
9,812,799 B2 11/2017 Wittig
9,985,367 B2 5/2018 Wanha et al.
2001/0016438 A1 8/2001 Reed
2002/0111067 A1 8/2002 Sakurai et al.
2002/0157865 A1 10/2002 Noda
2002/0180554 A1 12/2002 Clark et al.
2003/0064616 A1 4/2003 Reed et al.
2003/0073331 A1 4/2003 Peloza et al.
2003/0222282 A1 12/2003 Fjelstad et al.
2004/0094328 A1 5/2004 Fjelstad et al.
2004/0121633 A1 6/2004 David et al.
2004/0155328 A1 8/2004 Kline
2004/0155734 A1 8/2004 Kosemura et al.
2004/0229510 A1 11/2004 Lloyd
2004/0264894 A1 12/2004 Cooke
2005/0006126 A1 1/2005 Aisenbrey
2005/0051810 A1 3/2005 Funakura
2005/0093127 A1 5/2005 Fjelstad et al.
2005/0130490 A1 6/2005 Rose
2005/0142944 A1 6/2005 Ling et al.
2005/0239339 A1 10/2005 Pepe
2006/0001163 A1 1/2006 Kolbehdari et al.
2006/0035523 A1 2/2006 Kuroda et al.
2006/0038287 A1 2/2006 Hamasaki
2006/0079102 A1 4/2006 DeLessert
2006/0079119 A1 4/2006 Wu
2006/0091507 A1 5/2006 Fjelstad et al.
2006/0114016 A1 6/2006 Suzuki
2006/0160399 A1 7/2006 Dawiedczyk
2006/0189212 A1 8/2006 Avery
2006/0194475 A1 8/2006 Miyazaki
2006/0216969 A1 9/2006 Bright
2006/0228922 A1 10/2006 Morriss
2006/0234556 A1 10/2006 Wu
2006/0238991 A1 10/2006 Drako
2006/0282724 A1 12/2006 Roulo
2006/0292898 A1 12/2006 Meredith
2007/0032104 A1 2/2007 Yamada
2007/0141871 A1 6/2007 Scherer
2007/0243741 A1 10/2007 Yang
2008/0131997 A1 6/2008 Kim et al.
2008/0171476 A1 7/2008 Liu
2008/0297988 A1 12/2008 Chau
2008/0305689 A1 12/2008 Zhang et al.
2009/0023330 A1 1/2009 Stoner et al.
2009/0166082 A1 7/2009 Liu et al.
2009/0215309 A1 8/2009 Mongold et al.
2010/0068944 A1 3/2010 Scherer
2010/0112850 A1 5/2010 Rao
2010/0159829 A1 6/2010 McCormack
2010/0177489 A1 7/2010 Yagisawa
2010/0203768 A1 8/2010 Kondo
2011/0074213 A1 3/2011 Schaffer
2011/0080719 A1 4/2011 Jia

(56) References Cited

U.S. PATENT DOCUMENTS

| | | | |
|---|---|---|---|
| 2011/0136387 | A1 | 6/2011 | Matsuura |
| 2011/0177699 | A1 | 7/2011 | Crofoot et al. |
| 2011/0212633 | A1 | 9/2011 | Regnier |
| 2011/0230104 | A1 | 9/2011 | Lang |
| 2011/0263156 | A1 | 10/2011 | Ko |
| 2011/0300757 | A1 | 12/2011 | Regnier |
| 2011/0304966 | A1 | 12/2011 | Schrempp |
| 2012/0003848 | A1 | 1/2012 | Casher et al. |
| 2012/0034820 | A1 | 2/2012 | Lang |
| 2012/0225585 | A1 | 9/2012 | Lee |
| 2012/0246373 | A1 | 9/2012 | Chang |
| 2013/0005178 | A1 | 1/2013 | Straka et al. |
| 2013/0012038 | A1 | 1/2013 | Kirk |
| 2013/0017715 | A1 | 1/2013 | Van Laarhoven |
| 2013/0040482 | A1 | 2/2013 | Ngo |
| 2013/0092429 | A1 | 4/2013 | Ellison |
| 2013/0148321 | A1 | 6/2013 | Liang |
| 2013/0340251 | A1 | 12/2013 | Regnier |
| 2014/0041937 | A1 | 2/2014 | Lloyd |
| 2014/0073173 | A1 | 3/2014 | Yang |
| 2014/0073174 | A1 | 3/2014 | Yang |
| 2014/0073181 | A1 | 3/2014 | Yang |
| 2014/0111293 | A1 | 4/2014 | Madeberg et al. |
| 2014/0217571 | A1 | 8/2014 | Ganesan et al. |
| 2014/0242844 | A1 | 8/2014 | Wanha |
| 2014/0273551 | A1 | 9/2014 | Resendez |
| 2014/0273594 | A1 | 9/2014 | Jones et al. |
| 2014/0335736 | A1 | 11/2014 | Regnier |
| 2015/0079845 | A1 | 3/2015 | Wanha |
| 2015/0090491 | A1 | 4/2015 | Dunwoody |
| 2015/0180578 | A1 | 6/2015 | Leigh et al. |
| 2015/0207247 | A1 | 9/2015 | Chen et al. |
| 2016/0013596 | A1 | 1/2016 | Regnier |
| 2016/0064119 | A1 | 3/2016 | Grant |
| 2016/0104956 | A1 | 4/2016 | Santos |
| 2016/0181713 | A1 | 6/2016 | Peloza |
| 2016/0190720 | A1 | 6/2016 | Lindkamp |
| 2016/0190747 | A1 | 6/2016 | Regnier |
| 2016/0197423 | A1 | 7/2016 | Regnier |
| 2016/0218455 | A1 | 7/2016 | Sayre |
| 2016/0233598 | A1 | 8/2016 | Wittig |
| 2016/0233615 | A1 | 8/2016 | Scholeno |
| 2016/0336692 | A1 | 11/2016 | Champion |
| 2016/0380383 | A1 | 12/2016 | Lord |
| 2017/0033482 | A1 | 2/2017 | Liao |
| 2017/0033509 | A1 | 2/2017 | Liao |
| 2017/0077621 | A1 | 3/2017 | Liao |
| 2017/0098901 | A1 | 4/2017 | Regnier |
| 2017/0110222 | A1 | 4/2017 | Liptak et al. |
| 2017/0162960 | A1 | 6/2017 | Wanha |
| 2017/0302036 | A1 | 10/2017 | Regnier |
| 2017/0365942 | A1 | 10/2017 | Regnier |
| 2018/0034175 | A1 | 2/2018 | Lloyd |

FOREIGN PATENT DOCUMENTS

| | | | |
|---|---|---|---|
| CN | 1647323 | A | 7/2005 |
| CN | 102365907 | A | 2/2012 |
| DE | 3447556 | A1 | 10/1986 |
| JP | 02-079571 | U | 6/1990 |
| JP | 04-14372 | U1 | 2/1992 |
| JP | 05-059761 | U | 8/1993 |
| JP | 2008-041285 | A | 2/2008 |
| JP | 2008-059857 | A | 3/2008 |
| JP | 2009-043590 | A | 2/2009 |
| JP | 2010-017388 | A | 1/2010 |
| JP | 2010-123274 | A | 6/2010 |
| JP | 2013-016394 | A | 1/2013 |
| TW | M359141 | U | 6/2009 |
| TW | M408835 | U | 8/2011 |
| TW | 201225455 | A | 6/2012 |
| WO | WO 2008-072322 | A1 | 6/2008 |
| WO | WO 2012-078434 | A2 | 6/2012 |
| WO | WO 2013-006592 | A2 | 1/2013 |
| WO | 2016/112379 | A1 | 7/2016 |

OTHER PUBLICATIONS

International Preliminary Report on Patentability received for PCT Application No. PCT/US2016/012848, dated Jul. 20, 2017, 10 pages.

U.S. Appl. No. 61/714,871, filed Oct. 17, 2012, Wig et al.

Agilent, "Designing Scalable 10G Backplane Interconnect Systems Utilizing Advanced Verification Methodologies," White Paper, Published May 5, 2012, USA.

Amphenol Aerospace, "Size 8 High Speed Quadrax and Differential Twinax Contacts for Use in MIL-DTL-38999 Special Subminiature Cylindrical and ARINC 600 Rectangular Connectors", published May 2008. Retrieved from www.peigenesis.com/images/content/news/amphenol_quadrax.pdf.

Amphenol TCS, "Amphenol TCS expands the XCede Platform with 85 Ohm Connectors and High-Speed Cable Solutions," Press Release, Published Feb. 25, 2009, http://www.amphenol.com/about/news_archive/2009/58.

"File:Wrt54gl-layout.jpg-Embedded Xinu", Internet Citation, Sep. 8, 2006. Retrieved from the Internet: URL:http://xinu.mscs.edu/File:Wrt54gl-layout.jpg [retrieved on Sep. 23, 2014].

Hitachi Cable America Inc., "Direct Attach Cables: OMNIBIT supports 25 Gbit/s interconnections". Retrieved Aug. 10, 2017 from www.hca.hitachi-cable.com/products/hca/catalog/pdfs/direct-attach-cable-assemblies.pdf.

* cited by examiner

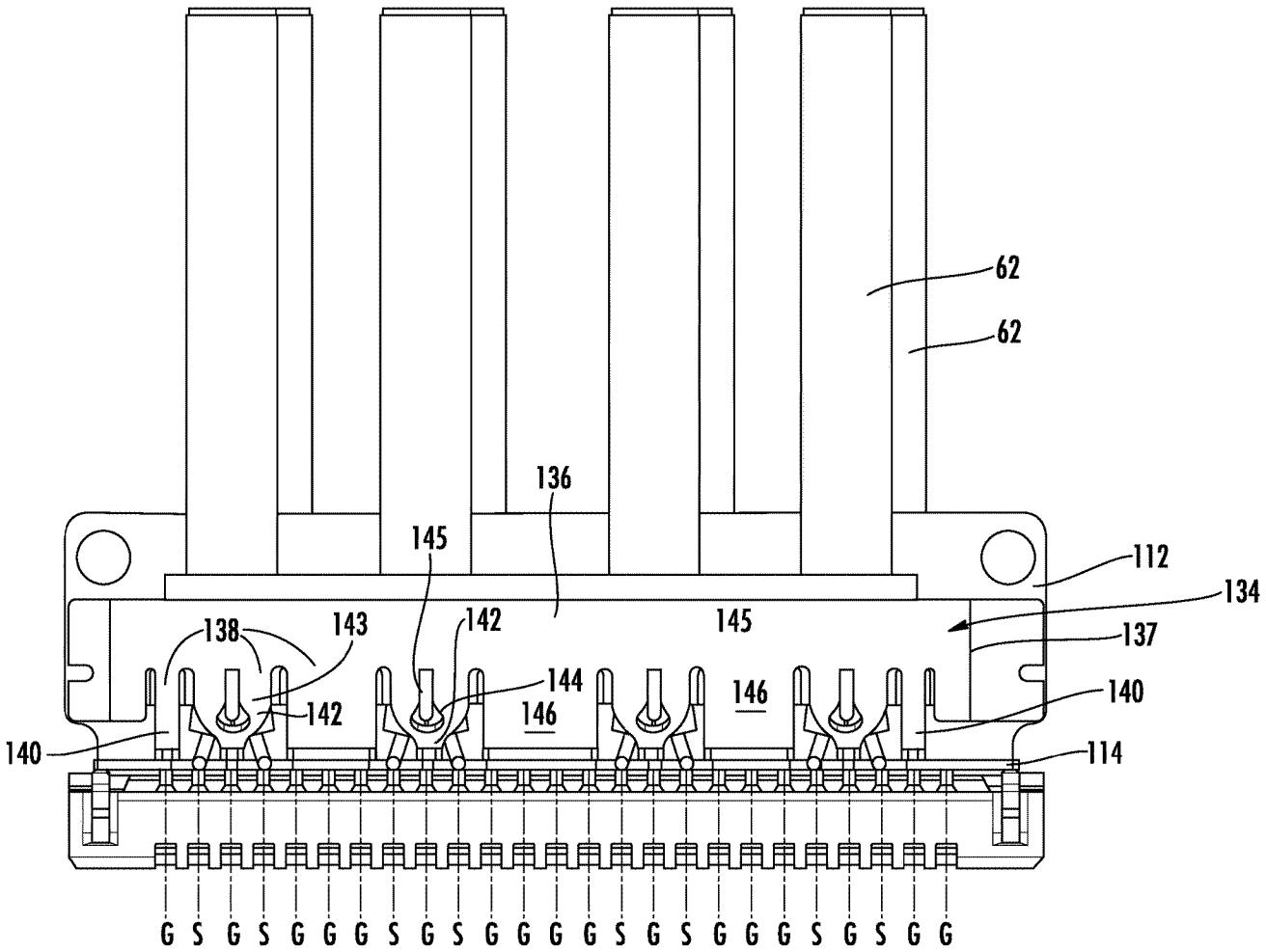
62
62
112
134
137
140
114
145
146
136
144
146
142
145
143
142
138
140
G S G S G S

CABLE CONNECTOR ASSEMBLY

REFERENCE TO RELATED APPLICATIONS

This application is a national stage of International Application No. PCT/US2017/012988, filed Jan. 11, 2017, which claims priority to U.S. Provisional Application No. 62/277,230, filed Jan. 11, 2016, both of which are incorporated herein by reference in their entirety.

BACKGROUND OF THE DISCLOSURE

The Present Disclosure relates generally to high speed data transmission systems suitable for use in transmitting high speed signals at low losses from chips or processors of a chip package to backplanes and devices, and more particularly to connectors suitable for use in integrated connector interface-chip package routing assemblies.

Electronic devices such as routers, servers, switches and the like need to transmit data at high data transmission speeds in order to serve the rising need for bandwidth and delivery of streaming audio and video in many end user devices. Chips are the heart of these routers, switches and other devices. These chips typically include a processor such as an ASIC (application specific integrated circuit) or an FPGA (field programmable gate array) and the like, these chips have dies that are typically connected to a substrate (creating a package) by way of conductive solder bumps or other convenient connection. The package may include micro-vias or plated through holes that extend through the substrate to solder balls. These solder balls comprise a ball grid array by which the package is attached to the motherboard. The motherboard includes numerous traces formed in it that define transmission lines which include differential signal pairs for the transmission of high speed data signal, ground paths associated with the differential signal pairs, and a variety of low speed transmission lines for power, clock and logic signals as well as other components. These traces include traces that are routed from the ASIC to the I/O connectors of the device into which external connectors are connected to provide a connection between one or more external plug connectors and the chip member. Other traces are routed from the ASIC to backplane connectors that permit the device to be connected to an overall system such as a network server or the like.

These conductive traces thus form transmission lines as part of the mother board and extend between the chip member and connectors to provide that provides a connection between one or more external plug connectors and the chip member. Circuit boards are usually formed from a material known as FR4, which is inexpensive. Although inexpensive, FR4 is known to promote losses in high speed signal transmission lines that transfer data at rates of about 6 Gbps and greater. These losses increase as the speed increases and therefore make FR4 material undesirable for the high speed data transfer applications of about 10 Gbps and greater. This drop off begins at about 6 Gbps (or 3 GHz using NRZ encoding) and increases as the data rate increases. In order to use such traces in FR4, a designer may have to utilize amplifiers and equalizers, which increase the final cost of the device.

Custom materials for circuit boards, such a MEGATRON, are available that reduce such losses, but the prices of these materials substantially increase the cost of the circuit board and, consequently, the electronic devices in which they are used. Additionally, when traces are used to form signal transmission lines, the overall length of the transmission lines can exceed threshold lengths at which problems to appear in operation. These lengths may approach 10 inches and longer in length and may include bends and turns that can create reflection and noise problems as well as additional losses. Losses can sometimes be corrected by the use of amplifiers, repeaters and equalizers but these elements increase the cost of manufacturing the circuit board. Do so, however, complicates the design inasmuch as additional board space is needed to accommodate these amplifiers and repeaters. In addition, the routing of the traces of such a transmission line may require multiple turns. These turns and the transitions that occur at terminations affect the integrity of the signals transmitted thereby. These custom circuit board materials thus become more lossy at frequencies above 10 Ghz than cable transmission lines. It then becomes difficult to route transmission line traces in a manner to achieve a consistent impedance and a low signal loss therethrough.

It therefore becomes difficult to adequately design signal transmission lines in circuit boards and backplanes to meet the crosstalk and loss requirements needed for high speed applications. Accordingly, certain individuals would appreciate a cable connector suitable for use in integrated, high speed, connector interface-chip package routing assembly that provides transmission lines for transmitting high speed data signals (above 20 Gbps) without using traces on the circuit board.

SUMMARY OF THE DISCLOSURE

The present disclosure is therefore directed to a cable connector that may be used in an integrated routing assembly that is structured to fit within the housing of an electronic device as a single element and provide multiple data transmission channels that lead directly from a chip or processor (of the ASIC or FPGA type) to external connector interfaces. The routing assembly preferably utilizes twin-ax cables as its cables for transmitting differential signals from the chip package to the connector interfaces and vice-versa. The cables may be free in their extent between the chip package and the external connector interfaces and secured to the tray by way of clips or the like. The cable may alternatively be embedded or encased within the body of the tray extending from a selected end of the tray to the chip-receiving opening where the conductors of the cables are terminated to board connectors of the present disclosure that enables the cable conductors to mate with corresponding opposing contacts of the chip package. The embedding of the cables in the body of the tray protects the twin-ax cables from damage during assembly.

The cable connectors help connector the conductors to a board or package that is supporting a chip and can have a low profile to help minimize impact on air flow in the system. The cable connector can be used to terminate the free ends of the conductors of the cables to terminals of the cable connector. In this manner, the mating connectors can be used adjacent (or even on) the chip package in order to retain a low profile and their impedance and other performance parameters are better controlled. The cable connector can include a conductive carrier that holds the cables in place and oriented so their associated signal conductor and drain wire free ends are positioned for termination by welding to the terminals supported by a connector housing. The carrier can include mounting feet.

In addition to the carrier, a grounding collar can be provided and the grounding collar can have multiple tails formed at one end thereof. These tails and the mounting feet of the carrier grounding feet are contacted together, forming a double thickness region, to help common the ground structure and can also be used to adjust impedance. This double thickness extends in the horizontal direction, while a second carrier may be provided and the two carriers provide a second increased thickness in the vertical direction.

The free ends of the cables are held together in a first spacing by spacers so that the signal conductors and drain wires of the cables are arranged in a desired spacing. Sets of cables may be held together in groups of four cables to accommodate four complete signal transmission channels of four transmit paths and four corresponding receive paths. The spacers are mounted on carriers, which can be conductive and mirror images of each other. The carriers can be elongated with top and base flanges. The top flanges extend vertically and the base flanges are offset from the top flanges and extend horizontally from them. The top and base flanges provide reference ground planes in two directions for the signal pairs provided by the cables.

The carriers include structure that allows the free ends of the signal conductor and drain wire free ends to extend in opposite directions. In this arrangement, the free ends of the signal conductors extend downwardly and outwardly, while the free ends of the drain wires extend upwardly. The base flange is configured with multiple slots that are spaced apart for their length. A ground collar can be attached to each carrier and the collars extend over the spacers in a manner so that the collars and carriers cooperatively define a continuous shield that encircles a selected portion of each spacer and over the free ends of the cables fixed therein. The free ends of the signal conductors and drain wires can exit the cables about even with an edge of each collar.

The ground collar has a plurality of tails that extend generally downwardly and out from the carriers at angles to the cables. The first tails are narrow and slightly uniform in their extent. The second tails have a tapered configuration and have a width that tapers along the length of the second tails from the ground collar to their tips. The third tails can be wider than the first and second tails and the third tails preferably extend to contact multiple terminals of the sub-connector. The first tails are arranged at the lengthwise ends of the carrier, while the second tails are positioned so they extend between the signal conductors of each cable signal pair. The third tails are positioned between each cable signal pair.

An elongated, insulative wire comb is provided for each carrier and it extends lengthwise of the carrier and has a series of wire-receiving slots that receive the free ends of the signal conductors. The comb holds the free ends in place for attachment but also isolates them from contacting one another in shorting contact. The second tails have openings formed in their wider (neck) sections occurring near the top of the tails and these openings receive the free ends of the drain wires. The free ends of the drain wires are bent upwardly and lie on the exterior surface of the collar. The wider tail extend down from the ground collar and then double back inwardly to match the exterior configuration of the spacers. In this manner the widthwise edges of the tails are generally aligned with the signal conductors so that edge coupling may occur with the third tails. The widths of the carrier flange feet tends to match those of the ground collar third tails.

BRIEF DESCRIPTION OF THE DRAWINGS

The present disclosure is illustrated by way of example and not limited in the accompanying Figures in which like reference numerals indicate similar elements and in which:

FIG. 6D depicts the embodiment shown in FIG. 6C with the ground collar in place;

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
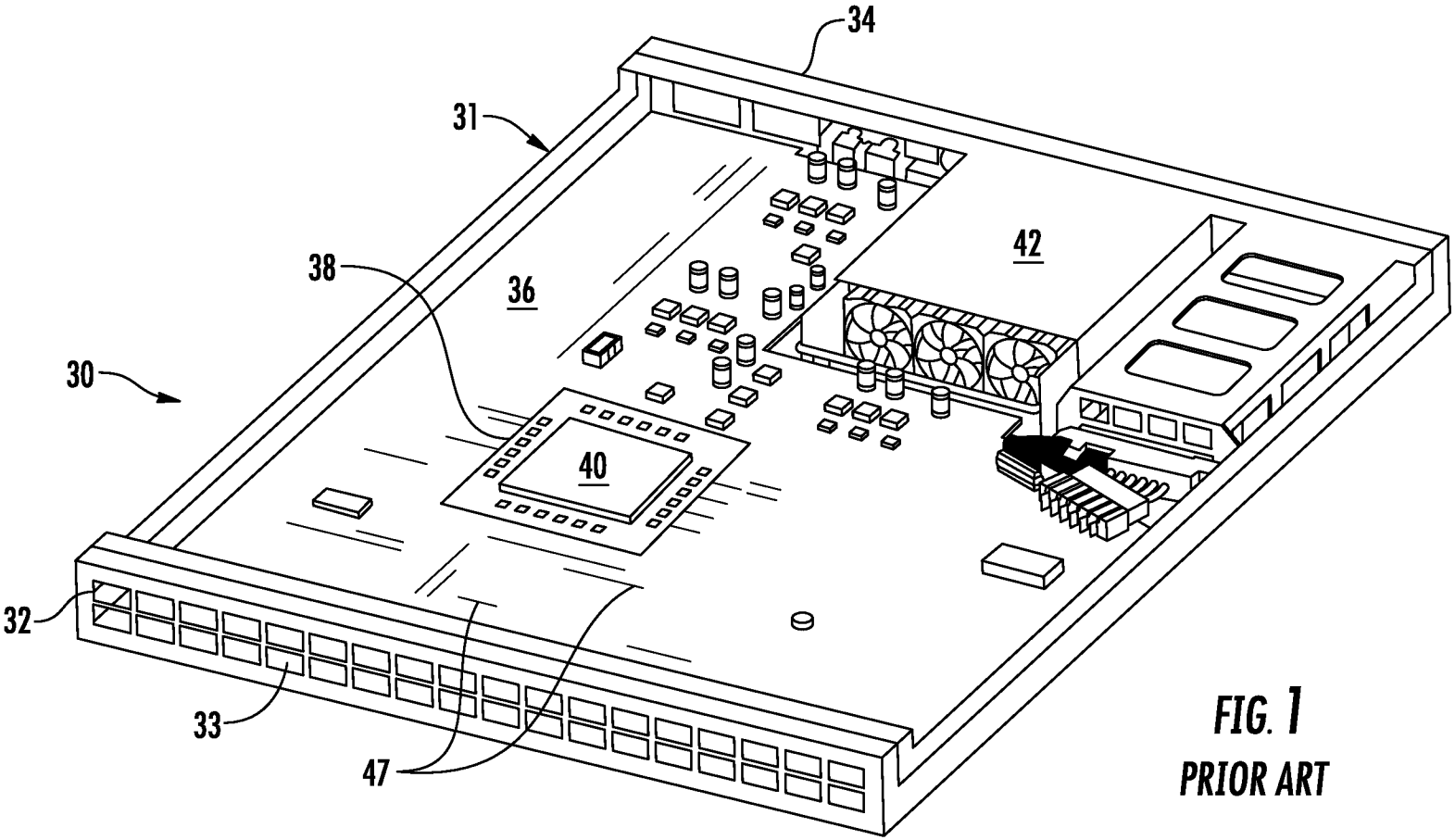
FIG. 1 PRIOR ART
FIG. 1 is a perspective view of the interior of a conventional electronic device with a chip package in place upon a motherboard.
Figure 1A:
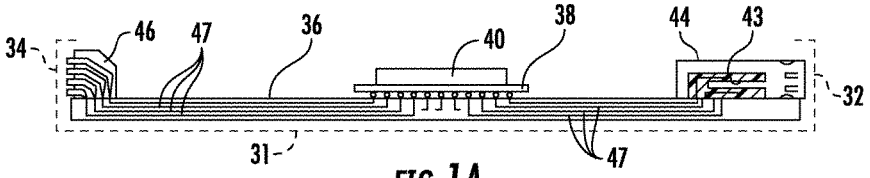
FIG. 1A PRIOR ART
FIG. 1A is a schematic sectional view of the electronic device of FIG. 1 illustrating how the circuit board is used for routing signal transmission channels between the chip package and the external connector interfaces of the device.

FIGS. 1 and 1A illustrates a conventional electronic device 30, such as a router, switch, etc. that has a sheet metal housing 31 with a front wall 32 and an opposing rear wall 34. The device 30 supports within the housing, a motherboard 36 that includes various electronic components such as a chip package 38 with an associated processor 40, a power supply 42 and additional integrated circuits, connectors, capacitors, resistors, etc. The front wall 32 has a series of openings 33 that are aligned with first connectors 43 to define connector ports for the device 30. An array of first connectors 43 are mounted to the motherboard 36 at the front end thereof and enclosed within metal shielding cages 44, or adapter frames, that are placed over the connectors 43 and onto the motherboard 36. Likewise, a series of second connectors 46 are mounted along the rear edge of the motherboard 36 and aligned with openings in the rear wall of the housing 31. These second connectors 46 may be a different style than the first connectors 43 (e.g., they could be a backplane style instead of an IO style).

In the known structure of the device of FIG. 1, the chip package 38 is connected to the first and second connectors by way of lengthy conductive traces 47 that extend from the chip package contacts through the motherboard 36 to the connectors 43, 46. Pairs of conductive traces 47 are required to define each differential signal transmission line and a third conductive trace will provide an associated ground that follows the path of the signal transmission line. Each such signal transmission line is routed through or on the motherboard and such routing has certain disadvantages. FR4 is the material that is commonly used for circuit boards, and unfortunately, it becomes relatively lossy at frequencies above 10 Ghz. Turns, bends and crossovers of these signal transmission line traces 47 are usually required to route the transmission line on the motherboard from the chip package contacts to the connectors. These directional changes in the traces can create signal reflection and noise problems, as well as additional losses. Although losses can sometimes be corrected by the use of amplifiers, repeaters and equalizers, these elements increase the cost of manufacturing of the final circuit (mother) board. This complicates the layout of the circuit board because additional board space is needed to accommodate such amplifiers and repeaters and this additional board space may not be available in the intended size of the device. Custom materials for circuit boards are available that are less lossy, but the cost of these materials increase the cost of the circuit board and, consequently, the host devices in which they are used. Still further, lengthy circuit traces require increased power to drive high speed signals through them and, as such, they hamper efforts by designers to develop "green" (energy-saving) devices.

In order to overcome these actual disadvantages, we have developed an integrated routing assembly 50 that incorporates the external connector interfaces of a host devices 51 into a single assembly and which provides a support for high speed differential pair signal transmission lines in the form of elongated cables 62 that extend between the connector interfaces and the chip package 88, eliminating the need for high speed routing traces on the motherboard 53. An embodiment of such an assembly is illustrated at 50 in FIG. 2. The depicted assembly 50 includes a front portion that accommodates a plurality of first connectors 57 and their associated housings 60 in preselected arrays, which are illustrated as four horizontal rows of connector housings 60 that are stacked vertically upon each other. Naturally, numerous other configurations are possible.

Figure 2:
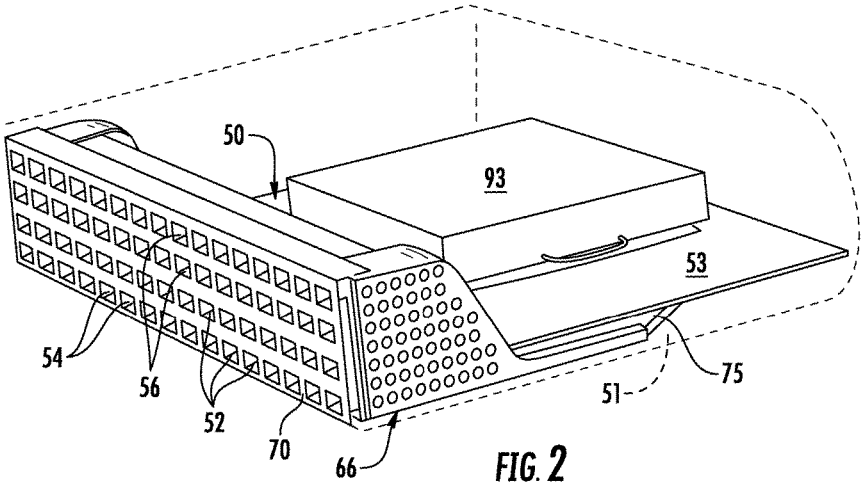
FIG. 2 is a perspective view of a routing assembly of the present disclosure in place underneath a motherboard and in which the chip package has a heat sink in place thereon.
Figure 3:
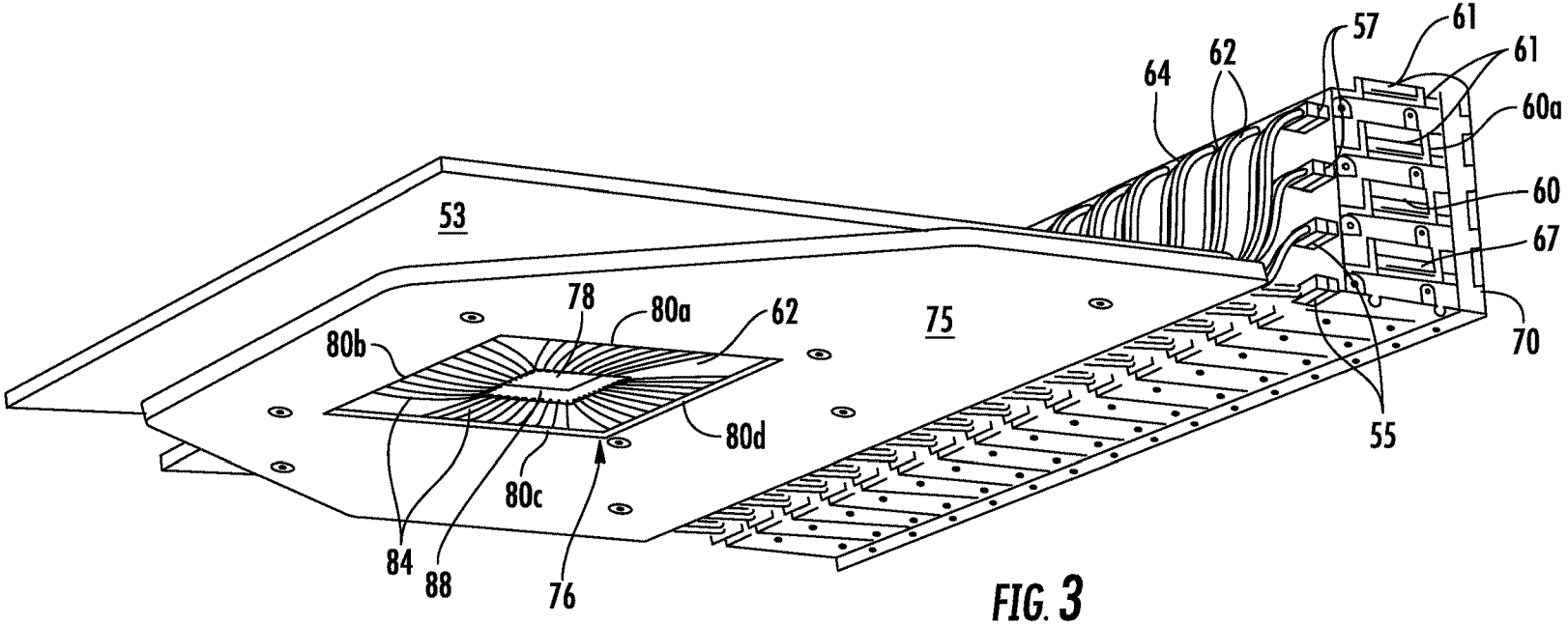
FIG. 3 is a perspective view of the routing assembly in place underneath a host device motherboard and contacting the chip package from below.

The connector housings 60 define the external connector interfaces for the device 50 in the form of connector ports 54, 56 and each such connector housing 60 contains a high speed connector 57, which can be a receptacle style connector. As can be appreciated, the connectors 57 can be arranged in horizontal rows in an integrated fashion, such as is depicted in FIGS. 2 & 3, where the connector housings 60 and associated connector heat sinks 61 are held in their horizontal extent and vertical alignment between support boards 67, by way of fasteners such as screws that extend through bosses 60*a* formed on the exterior of the connector housings 60. Such an arrangement can easily accommodate a face plate 70, or panel (see FIG. 3) that extends widthwise between two side supports 68 that cooperatively form a frame 66 of the assembly 50. The side supports 68 have rearwardly extending channels 72*a, b* that cooperatively define a plane in which a tray 75 extends, which, in combination with the connector housings, define a tray-like system with a general L-shaped configuration that is readily insertable into a host device housing.

The tray 75, as illustrated in FIG. 3, can be generally planar and has a predetermined thickness and can be formed of insulative or conductive materials, depending on the desire for shielding and other material properties. The tray 75 has a chip package-receiving opening 76 formed therein, which is shown in the Figures as located within the perimeter of the tray 75. The opening 76 is shown in the Figures as having a central portion 78 that may have four edges 80*a*-80*d* that define the opening 76.

The depicted connectors 57 of the connector housings 60 that form the array of connector ports 54, 56 are of the receptacle type having signal and ground terminals arranged in transmit and receive channel configurations to mate with opposing connectors having a plug connector style. Cables 62, which can be in a twin-ax configuration, are directly terminated at their distal ends 82 to the connector terminals of each connector 57 at first ends of the cables 62 and are seen in FIG. 3 to flank low speed wires 64 (which can be used for logic, clock, power and other desired uses). The cables 62 include a pair of signal conductors 119 in a desired spacing surrounded by a dielectric covering 121 and preferably include an associated drain wire 120 and can include an outer conductive covering that is enclosed in an insulative outer jacket 122. The cables 62 maintain the ordered geometry of the signal conductors throughout their lengths as they traverse from the chip package 88 to the entry and exit connectors 54, 56. Because this geometry remains ordered through their length, the cables 62 may easily be turned or bent or crossed in their paths without introducing problematic signal reflection or impedance discontinuities into the transmission lines.

Figure 2A:
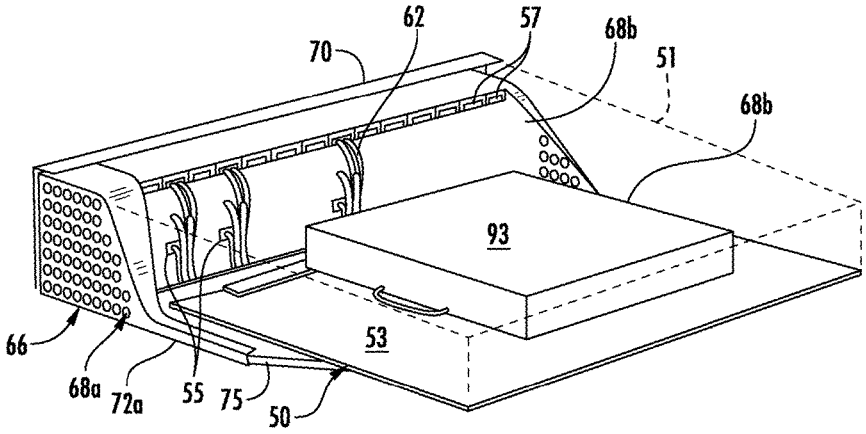
FIG. 2A is another perspective view of the embodiment depicted in FIG. 2 taken from the rear.
Figure 2B:
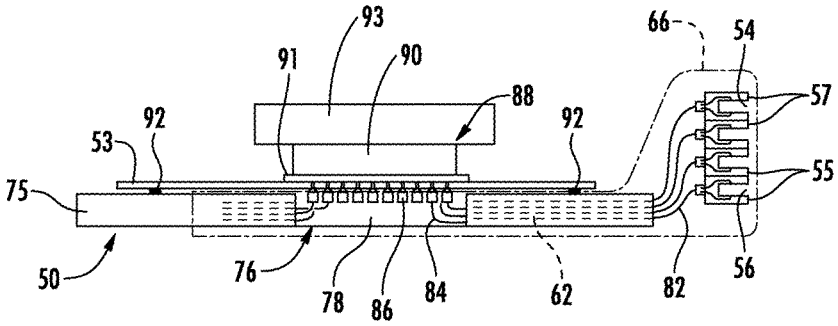
FIG. 2B is a schematic sectional view of the routing assembly of FIG. 2 illustrating how the cables are embedded within the tray for routing signal transmission channels between a chip package substrate and the external connector interfaces of the assembly.

Both the cables 62 and low speed wires 64 are terminated directly at their first ends to first terminals of the first connector 57. The first terminals are thus not required to be mated to the motherboard 53 and this helps avoid the impedance discontinuities which normally occur at a connector-circuit board mounting interface. The cables 62 are illustrated as arranged in vertical rows at the rear of the connector housings 60. The cables 62 are arranged in vertical rows as best shown in FIG. 2B, with the cables 62 and low speed wires 64 of the lower connector housing rows arranged inwardly of the topmost connector housing row. This promotes orderly arrangement of the cables 62 in their extent from the connectors 54, 56 to the tray 75. In the assembly 50 depicted the cables 62 associated with the top three rows of connectors 57 are seen to have a general S-shaped configuration extending downward to the level of the tray 75 and into the substrate at the front end thereof, while the cables in the bottommost row extend almost horizontally into the tray 75.

The cables 62 lead from the rear of the connectors to the front edge of the tray 75 where they enter the body of the tray 75. The proximal ends 84 of the cables 62 extend into the tray opening 76 as illustrated where they are mated to connectors 86 that will mate with the chip package 88. These connectors 86 are preferably of the wire-to-board style so that the signal conductors and ground of the cables 62 can be easily connected to contacts on the chip package substrate 91. The second ends of the cables 62 exit the tray 75 to enter the chip package-receiving opening 76. In one aspect of the present disclosure, the chip package 88 and associated chip 90 are disposed on the device motherboard 53, and the chip package 88 includes a plurality of contacts in the form of receptacle style connectors 86 that are preferably arranged around the perimeter thereof and aligned with the tray opening 76 to align with the connectors 86 at the cable proximal ends 84. In another aspect, the chip package/processor 88, 90 may be included as part of the overall routing assembly 74. In another aspect, as illustrated in FIGS. 2 & 2A, the area above the host device motherboard 53 is free to accommodate thermal transfer members 93, such as heat spreaders and/or heat sinks having perimeters larger than that of the processor 90 because the integration of the cables 62 into the tray 75 frees up most of the space above the tray 75 for other uses.

Figure 5:
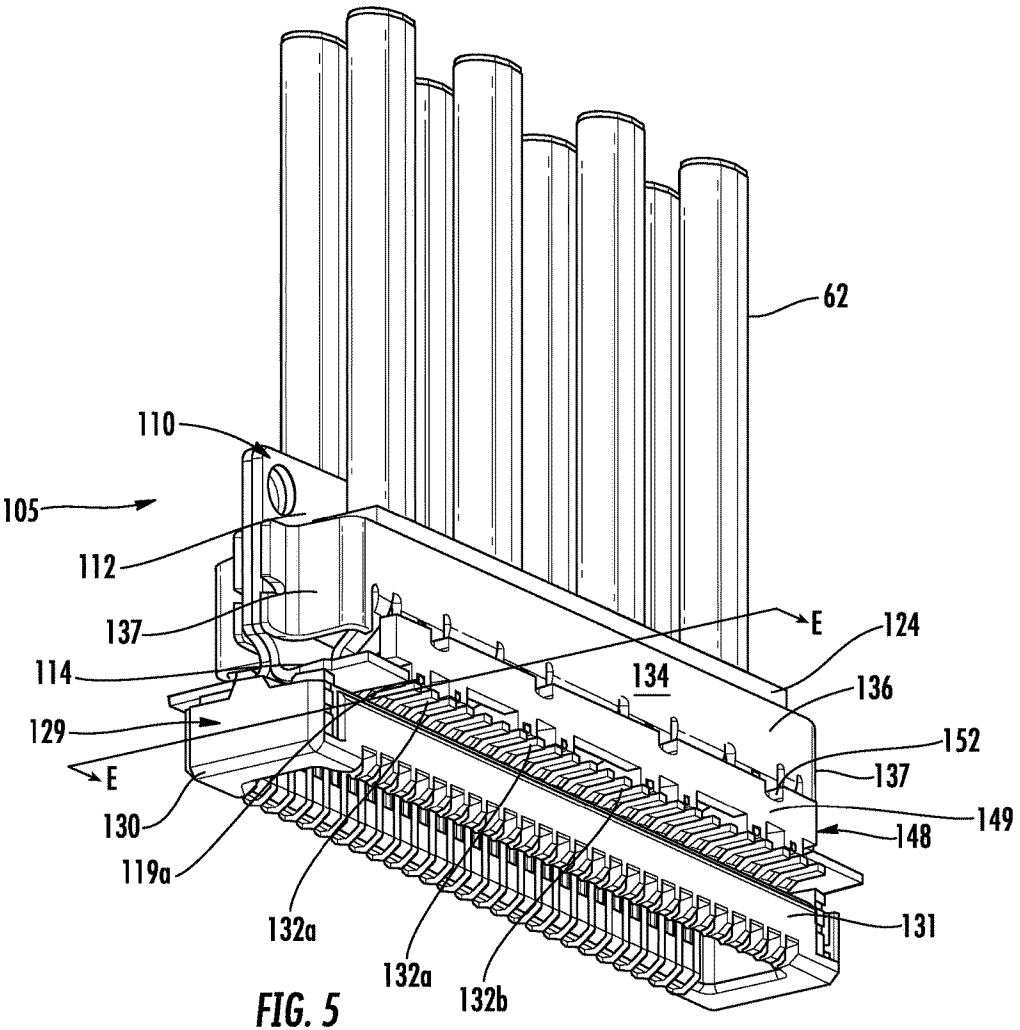
FIG. 5 is a perspective view of the cable connector depicted in FIG. 4B with the strain relief portion removed for clarity.
Figure 5A:
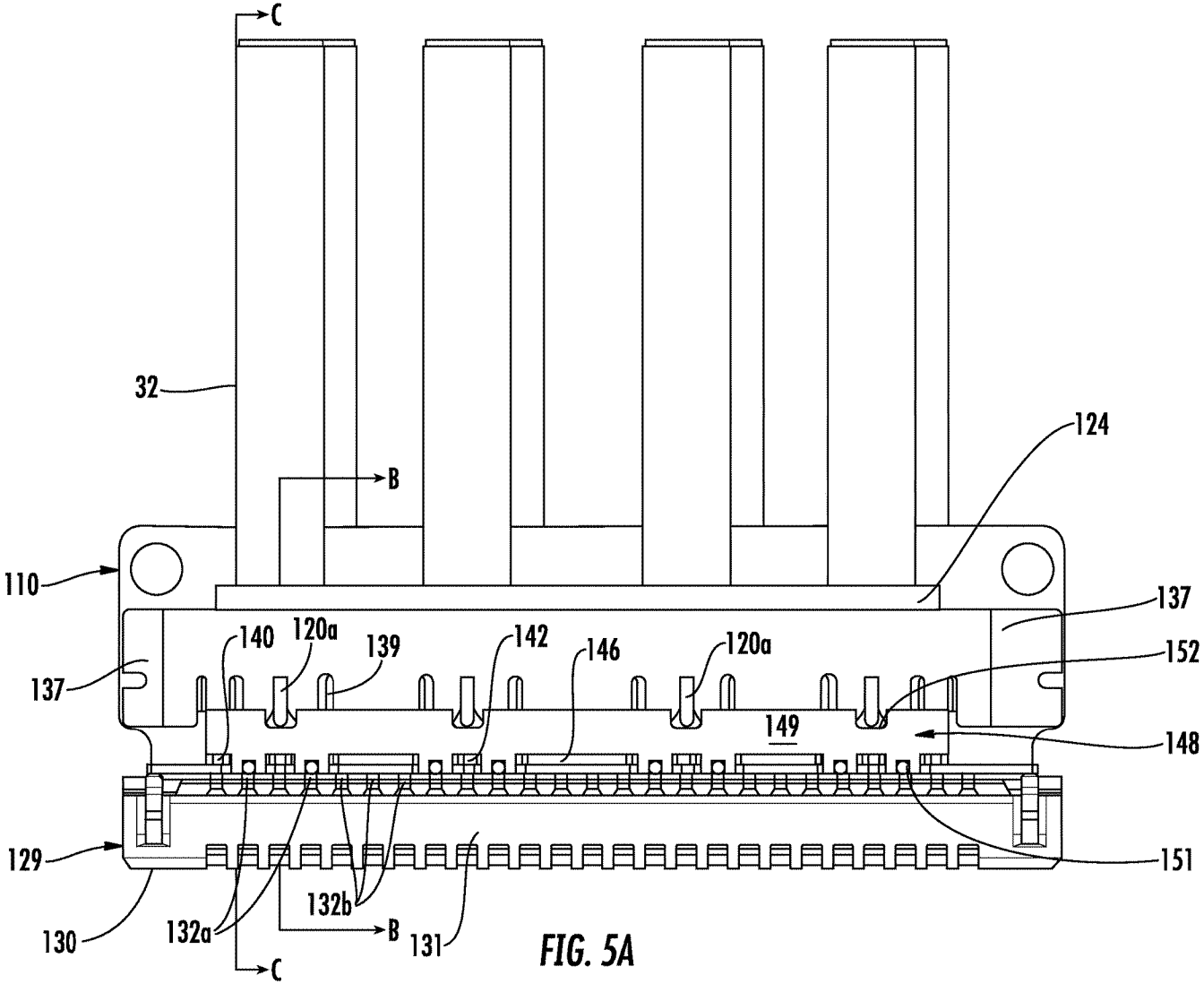
FIG. 5A is a side elevational view of the cable-connector assembly of FIG. 5.
Figure 5B:
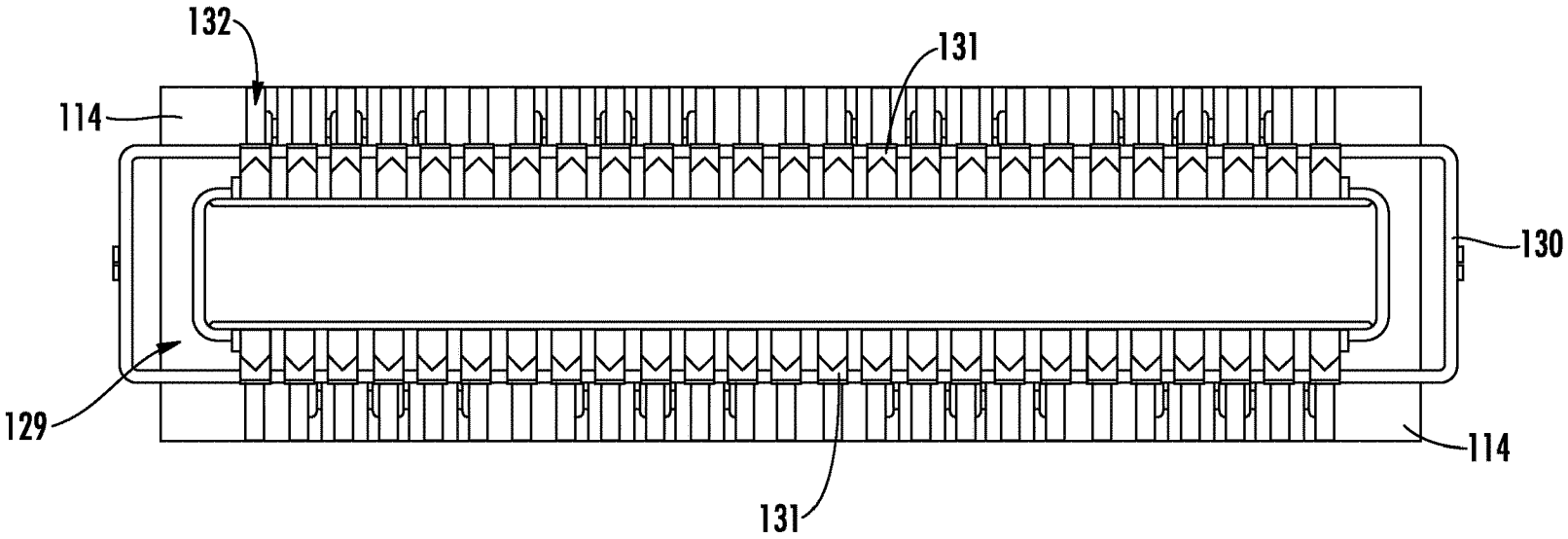
FIG. 5B is a plan view of the cable-connector assembly of FIG. 5.

The cables 62 (and low power wires 64) may be positioned as part of the tray 75 in a variety of ways that suitably holds them in place from where they enter the routing assembly 74, such as along the leading edge 83 of the tray 75 to where they exit the tray 75 and enter the tray opening 76. The cables 62 can be accommodated in the tray 75 by enclosing them in a suitable dielectric material, such as a plastic. The body portions of the cables 62 can be completely surrounded by the dielectric material of tray 75 so that the two are integrally formed as a single part that can be inserted into the routing assembly 74 as a tray portion. One routing pattern of the cables 62 is illustrated in FIG. 5, which has the upper portion of the tray 75 removed for clarity to show the paths in which the cables 62 are laid.

Figure 3A:
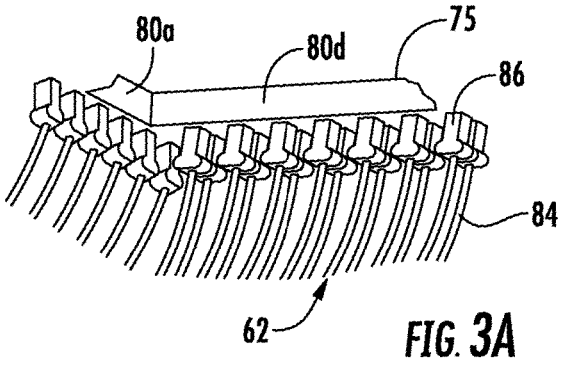
FIG. 3A is a schematic sectional view of the routing assembly of FIG. 8 illustrating how the tray is positioned beneath the motherboard of the host device and the connection of the cables to the chip package and the external connector interfaces of the device.

The cables 62 are terminated at their second ends 84 to the aforementioned chip package connectors 86 either before or after the forming of the tray 75. Inasmuch as the first ends of the cables 62 are directly terminated to the terminals of the cable direct connectors 57, the second connectors 86 permit the cables 62 to be directly connected to the chip package 88, thereby completely bypassing the motherboard 53 as a routing support. In such an instance, the routing assembly 74 may be inserted into the host device housing and the motherboard 53 is placed in the housing of the device 51 over the tray 75, where it may be spaced apart from and above the motherboard by standoffs 92 or the like. FIGS. 3 & 3A illustrate the connectors 86 and their associated housings 87 and mating faces 89 facing upwardly in the opening 76 and into contact with the chip package 88. The connector housings 87 may take the form of chiclets which can house as little as a single pair of signal conductors. Accordingly, they can easily mate with receptacle connectors on the chip package substrate 91. The connectors 86 and their mating receptacle connectors may be made small in dimension so as to fit within the opening 76 and not project outside of the opening 76 an undesirable amount so as not to increase the size of the routing assembly 74.

Figure 4:
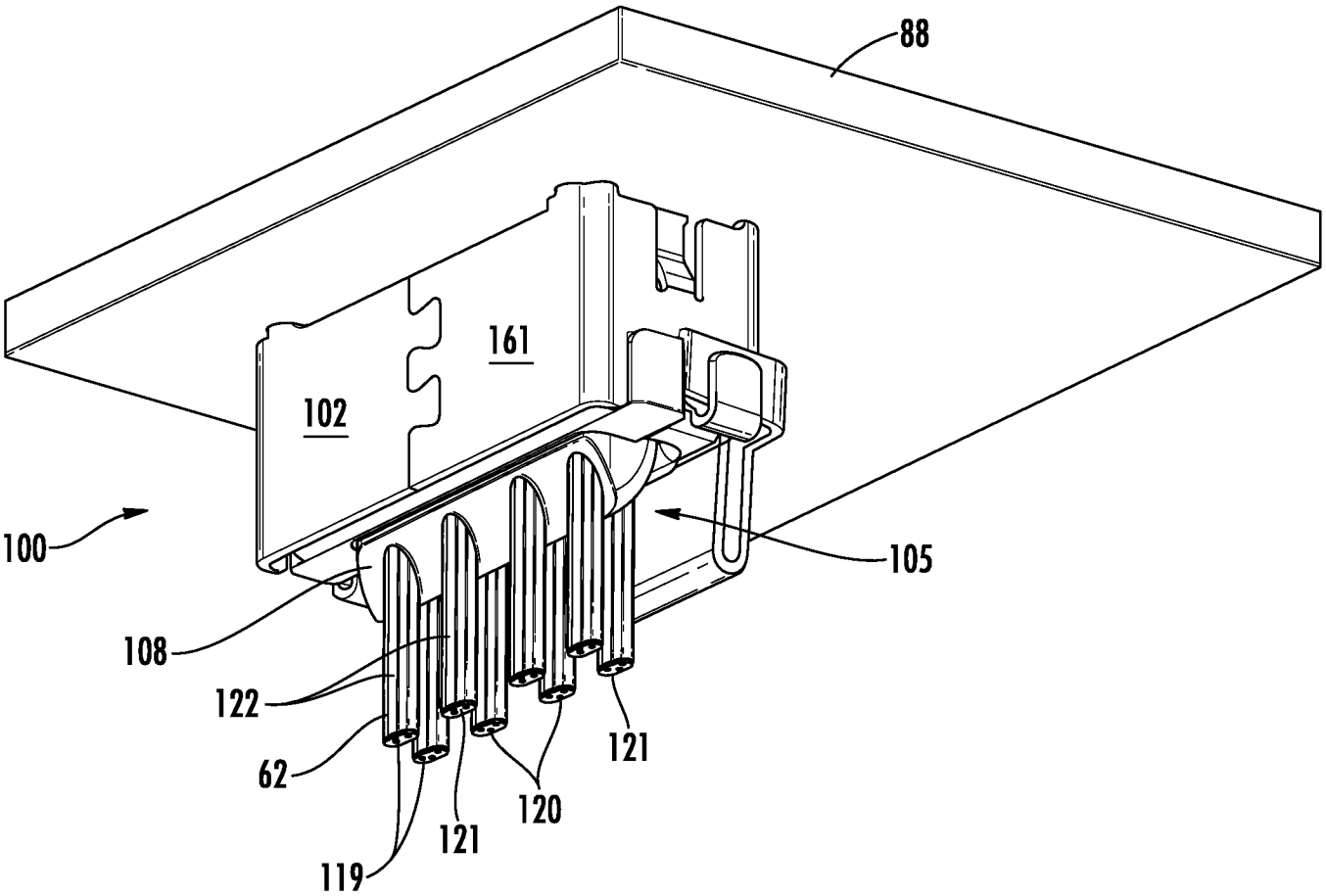
FIG. 4 is a perspective view of a wire-to-board connector assembly in the same underside orientation as provided in FIG. 3.
Figure 4A:
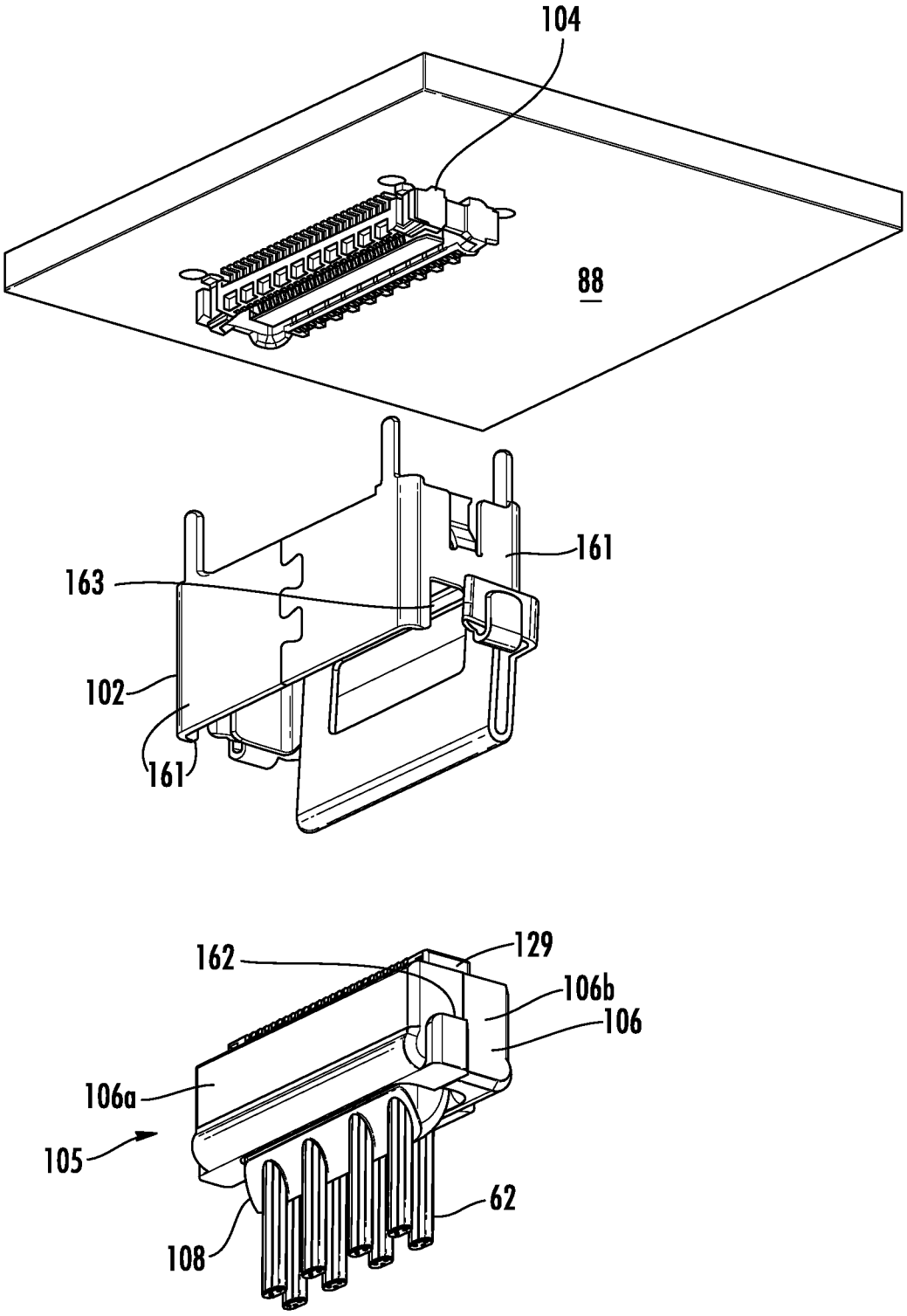
FIG. 4A is a partially exploded view of the embodiment depicted in FIG. 4, illustrating the receptacle portion fixed to the motherboard and the housing, and cable connector spaced apart for clarity.
Figure 4B:
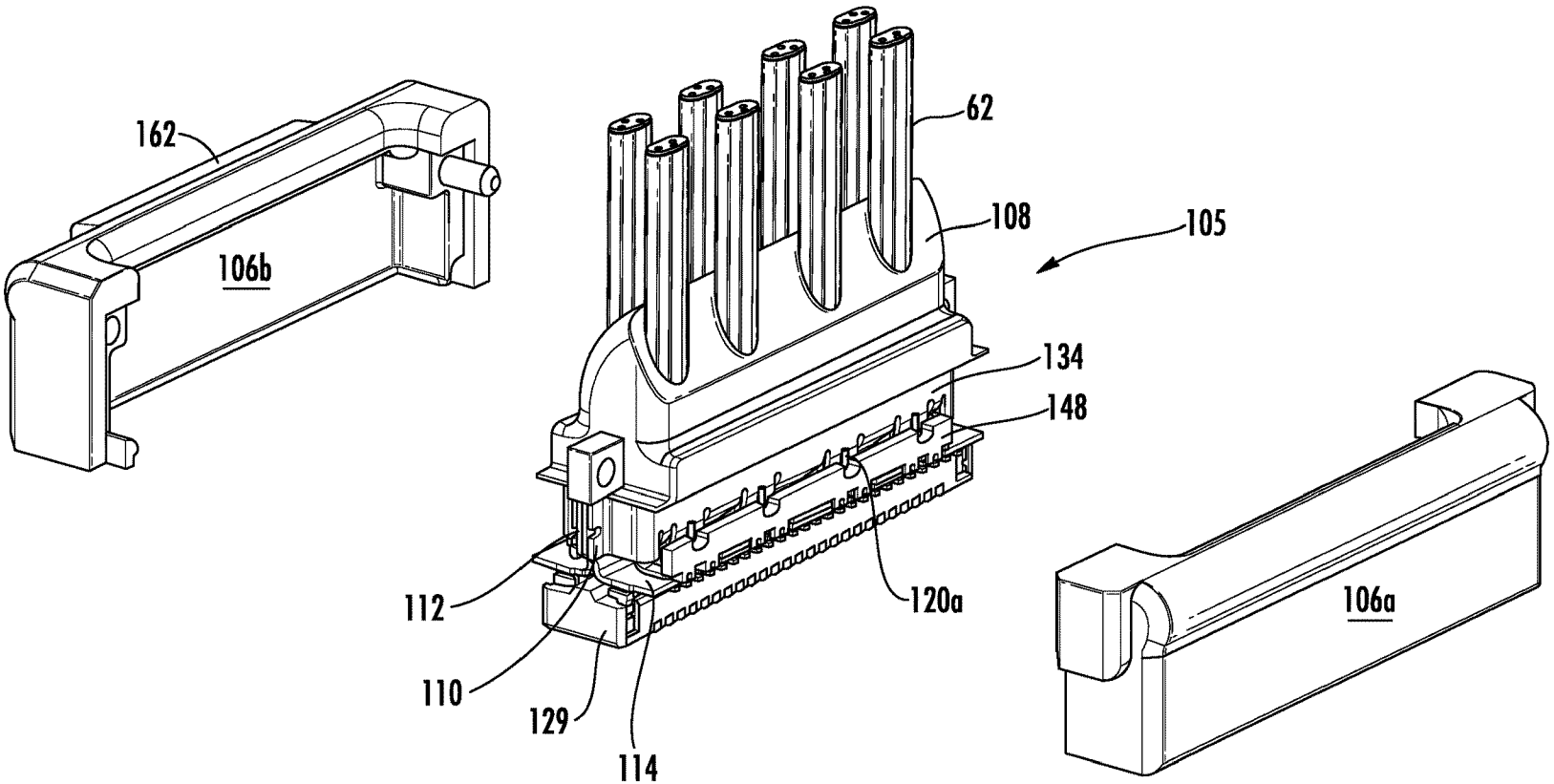
FIG. 4B is an exploded view of the cable connector of FIG. 4A, but in a different orientation.

FIGS. 4-4B illustrate a connector assembly 100 of the wire-to-board style that is suitable for use with an embodiment of the bypass routing assemblies. The connector assembly 100 is shown attached to the underside of a chip package substrate and it includes a cage 102 that engages a board 88 and encircles a board connector 104 and provides a receptacle for cable connector 105. The board connector 104 preferably has a receptacle configuration and being of the board-to-board style, has a low profile so that it and its cage 102 (along with the mating connector fit within the chip package opening. The cable connector 105 supports sets of cables 62 that terminate to sub-connector 129. The cable connector 105 includes a first housing 106 that has two halves, 106*a*, 106*b* that engage each other and partially enclose the sub-connector 129. The cage 102 includes a series of walls 161 that cooperatively define a hollow enclosure which receives the cable connector 105 therein. One of the connector housing halves 106*a* may include a tab 162 that is received within a retention slot 163. An overmolded portion 108 may be formed to provide a measure of strain relief for the cable connector 105.

Although the cable connector 105 can be used in an upside-down manner, as shown in FIGS. 3A, 4, 4A, 9 & 9A, where it connects to the underside of a board or substrate, it will be mostly illustrated in the opposite orientation in the Figures to follow. The orientation used will depend on system configuration but the operation and the structure of the cable connector 105 is not impacted by the orientation and the cable connector 105 may be used in any desired orientation.

FIGS. 5-8D illustrate features of the cable connector 105 without the first housing 106. As shown in FIG. 5, the cable connector 105 includes a plurality of cables 62, each of which contains a differential signal air that includes a pair of signal conductors 119 enclosed in a dielectric material 121 with an associated ground conductor 120, such as a drain wire, all of which are enclosed within an outer insulative jacket 122. The cables 62 are held in a carrier 110 and free ends 119*a* of the signal conductors 119 are terminated to corresponding terminals 132 of the sub-connector 129. The sub-connector 129 has a sub-housing 130 formed of an insulative material and a series of sidewalls 131 that form a plug portion that is received in the receptacle portion of the board connector 104. The depicted embodiments illustrate a way of connecting the cable conductor free ends to the terminals of the sub-connector 129 that reduces impedance discontinuities, noise and crosstalk and while help to keep the overall profile of the cable connector 105 low.

A carrier 110 is formed in an elongated fashion out of conductive material and has a general L-shaped configuration that is formed from a top flange 112 and a base flange 114. The base flange 114 defines a base of the carrier 110 that abuts the mating surface 171 of the sub-connector 129 when the cable connector 105 is assembled. The base flange 114 has a series of pairs of slots 116 formed in it that extend widthwise of the assembly 105 as illustrated. The slots 116 can be seen to be generally perpendicular to a centerline of the assembly 105 and which define mounting feet 117, 118 of the carrier. These mounting feet 117, 118 contact selected ground terminals 132*b* of the sub-connector 129.

The top flange 112 and the base flange 114 extend in two different directions, the top flange 112 extending alongside the ends of the cables and the base flange 114 extending beneath the cable ends. This extent provides two reference ground planes in two planes with respect to the ends of the cables. The carrier 110 can provided on two opposing sides of the cable connector 105.

Figure 7:
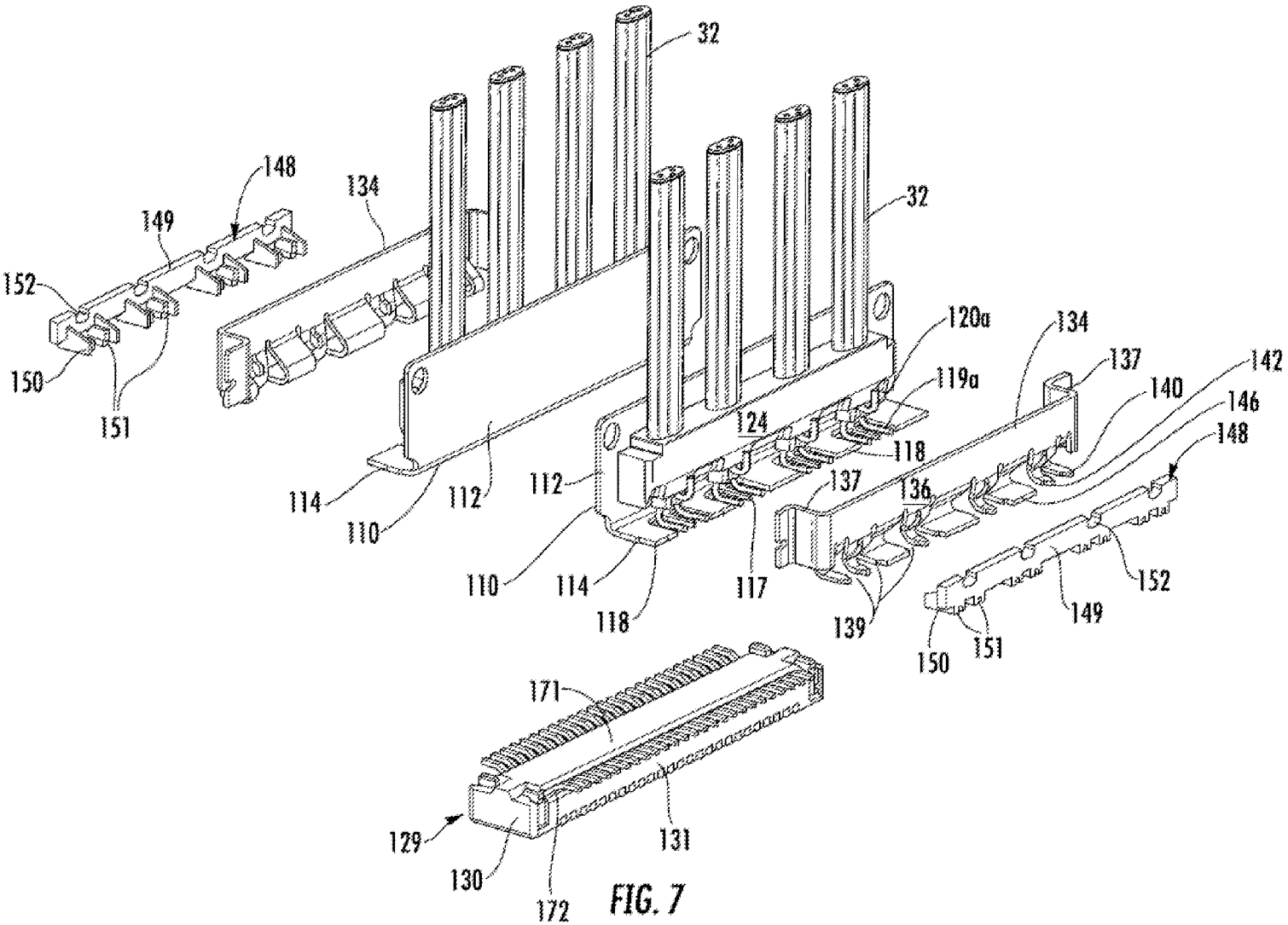
FIG. 7 is an exploded perspective view of the cable connector depicted in FIG. 6.
Figure 7A:
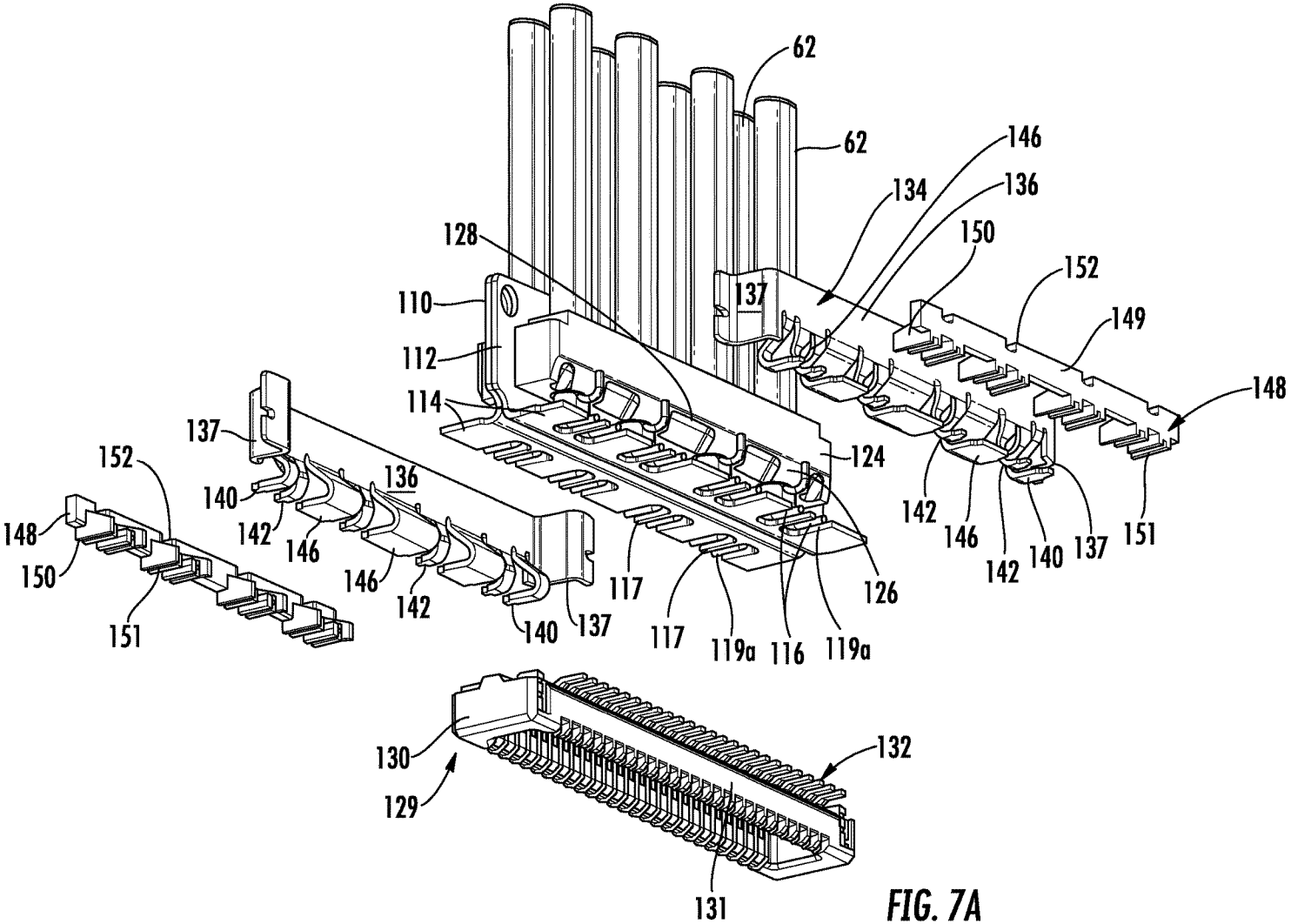
FIG. 7A is another perspective view of the embodiment depicted in FIG. 7.
Figure 7B:
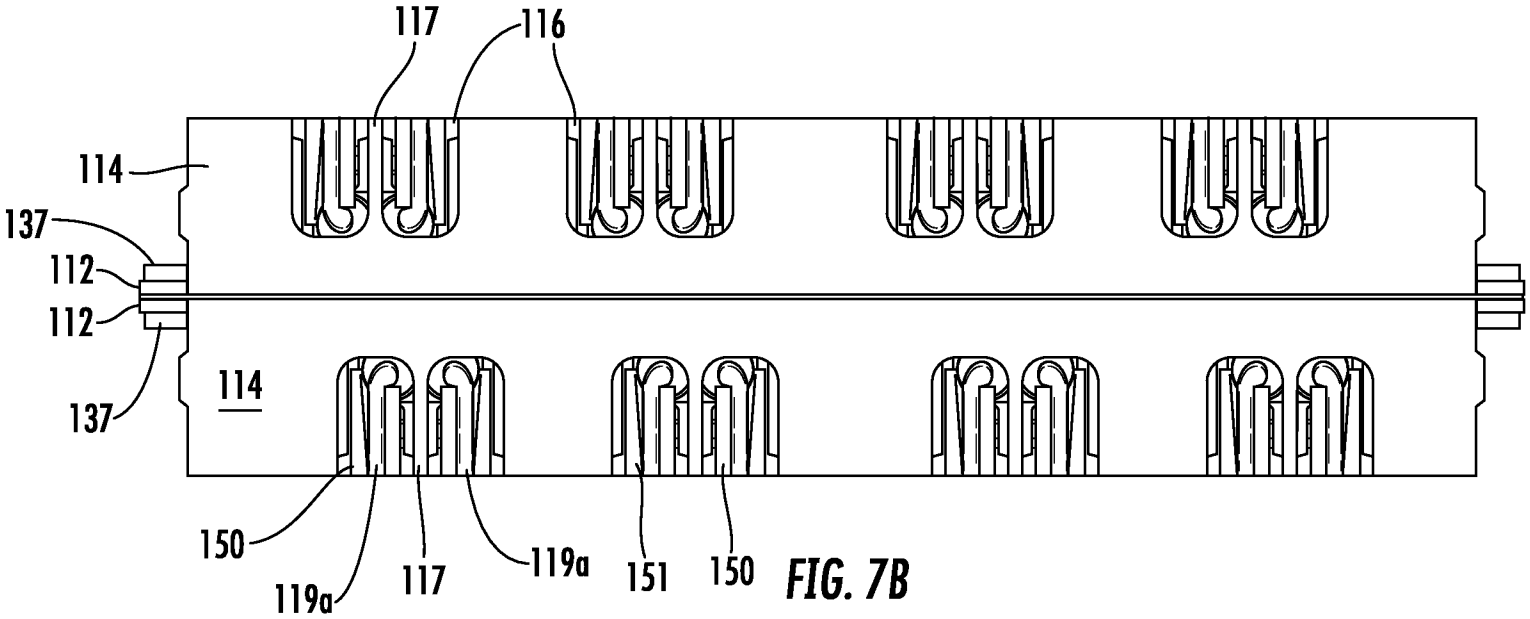
FIG. 7B is a simplified bottom view of the embodiment depicted in FIG. 7A, showing the carrier.

The base flange 114 contacts the mating surface 170 of the sub-connector 129. This mating surface 170 extends lengthwise along the sub-connector 129 and includes a center base 171 that is flanked by two side slots 172 through which the terminals 132 extend in spaced-apart order along the length of the mating surface 170. As illustrated in FIGS. 7A & 7B, the base flange 114 includes slots 116. The slots 116 are located in the base flange 114 in alignment with the free ends 119*a* of the signal conductors 119 and they receive a least a portion of the free ends 119*a* therein. The slots 116 are arranged in pairs (one on each side of a mounting foot 117) as illustrated in FIG. 7B in order to accommodate the signal conductor free ends 119*a* of a differential signal transmission channel.

As noted above, the base flange 114 abuts the mounting surface 171 of the sub-connector 129 so that the slots 116 are aligned with signal terminals 132*a* of the sub-connector 129. The slots 116 extend along a length of the sub-connector 129 and have a width sufficient to prevent shorting contact from occurring between the base flange 114 and the signal conductors 119 and connector signal terminals 132*a*. As depicted, a ground terminal is positioned between the signal pair and two adjacent slots 116 are separated by the mounting foot 117, which provides a contact point for a ground terminal 132*b* of the sub-connector 129 and a second tail 142. Wider mounting feet 118 are shown located between two pairs of slots 116 and the mounting feet 118 can contact multiple adjacent ground terminals 132*b* in order to maintain a desired pinout and common the grounds. If two carriers 110 are aligned back to back, as illustrated, the carriers 110 may be aligned so that the cables 62 are offset (as shown).

Figure 5C:
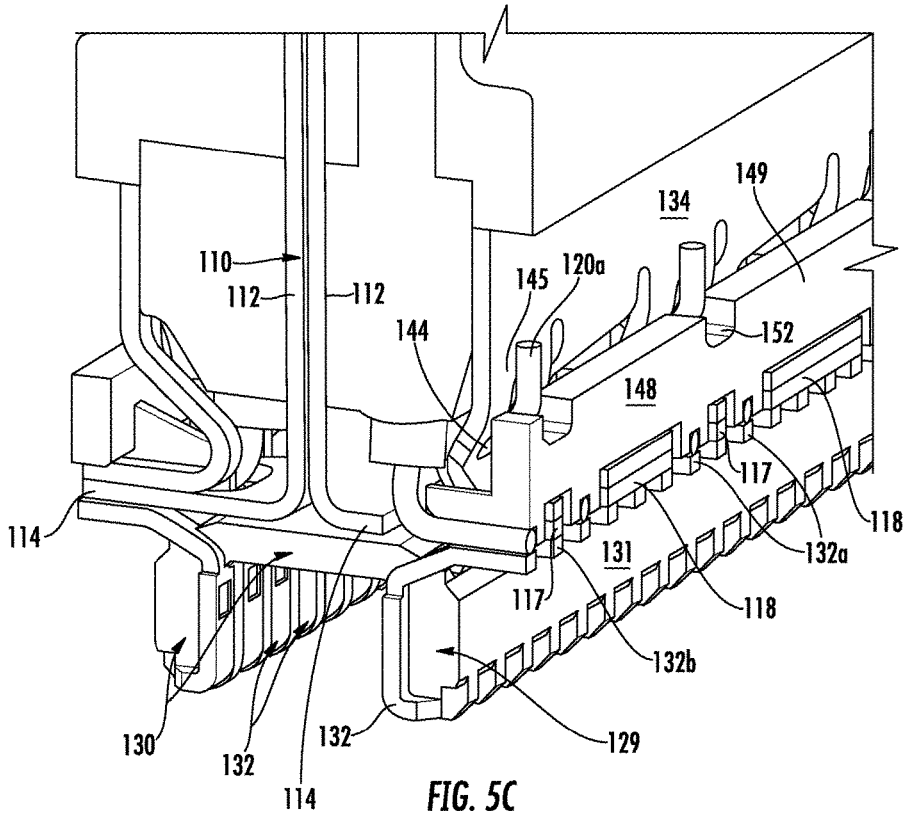
FIG. 5C is a vertical sectional view taken along lines C-C of the assembly of FIG. 5.
Figure 6:
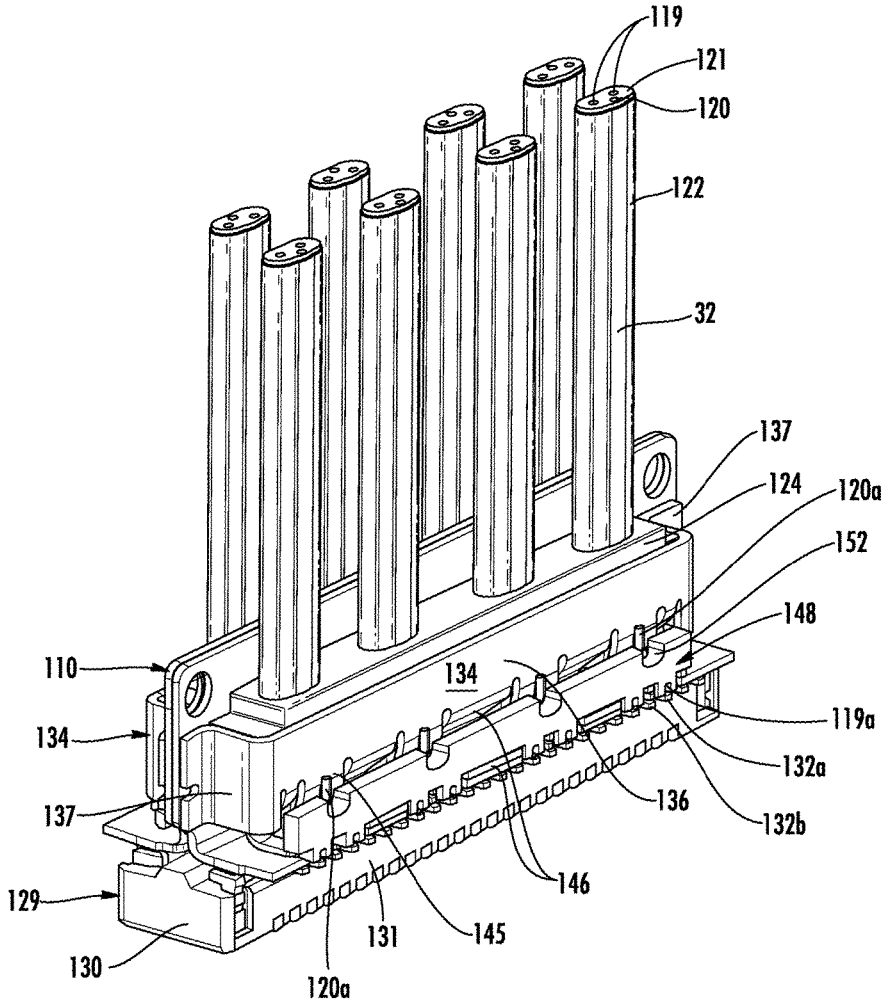
FIG. 6 is another perspective view of the embodiment depicted in FIG. 5.
Figure 6A:
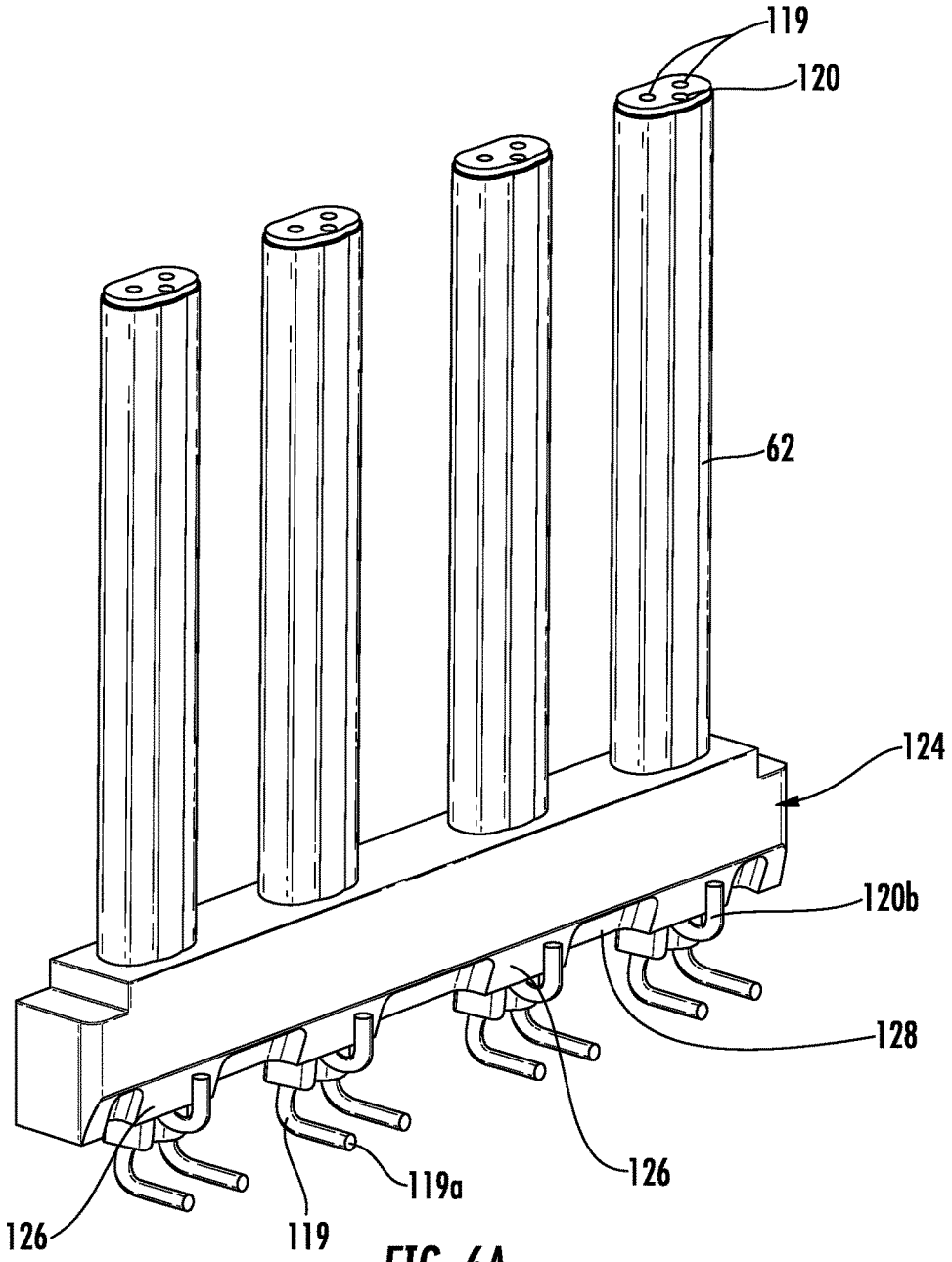
FIG. 6A is a perspective view of the cables held in place within the assembly spacer.
Figure 6B:
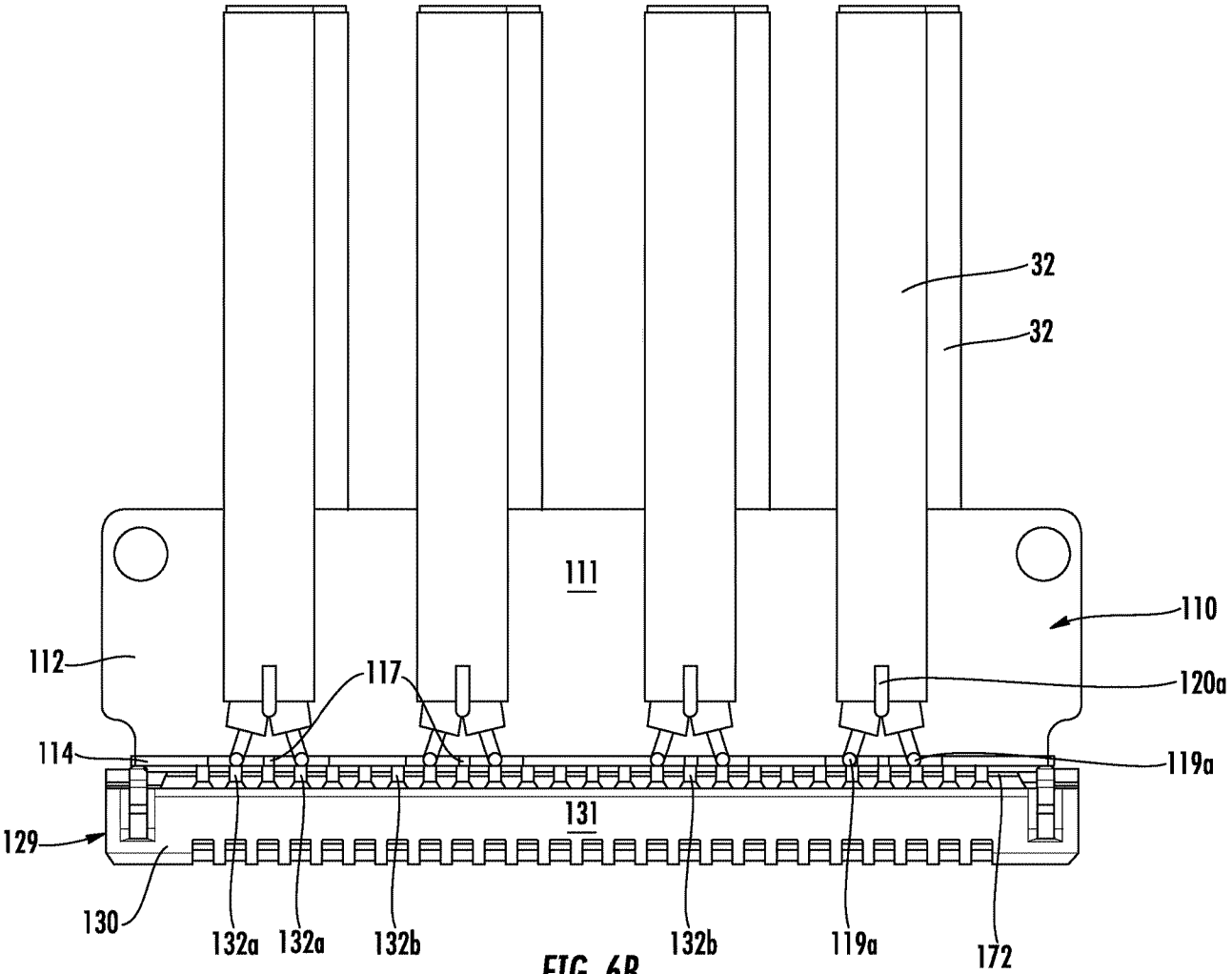
FIG. 6B is a simplified side elevational view of the assembly of FIG. 6, illustrating the conductors of the cables in contact with terminals.
Figure 6C:
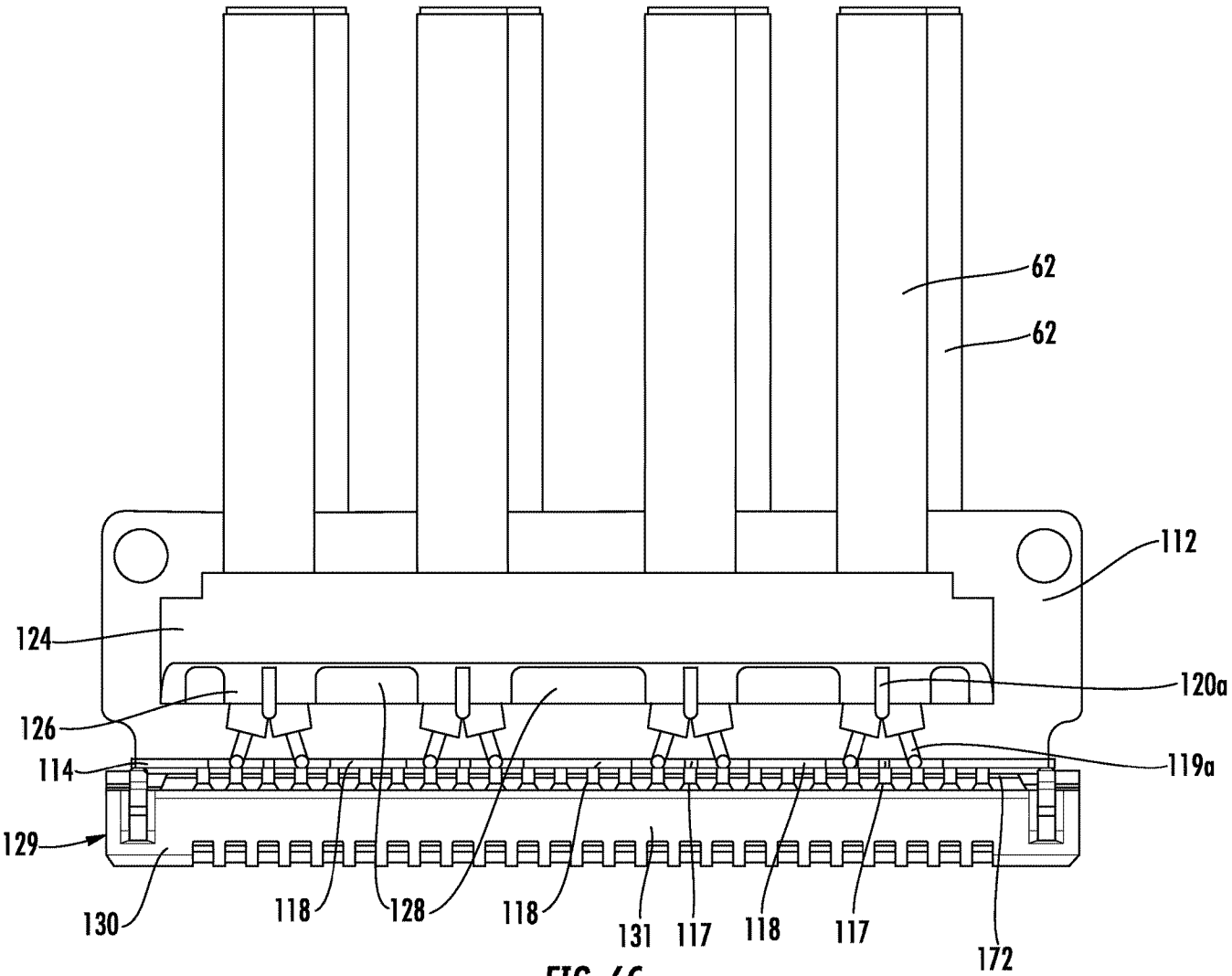
FIG. 6C depicts the embodiment shown in FIG. 6B with the spacer in place.
Figure 7C:
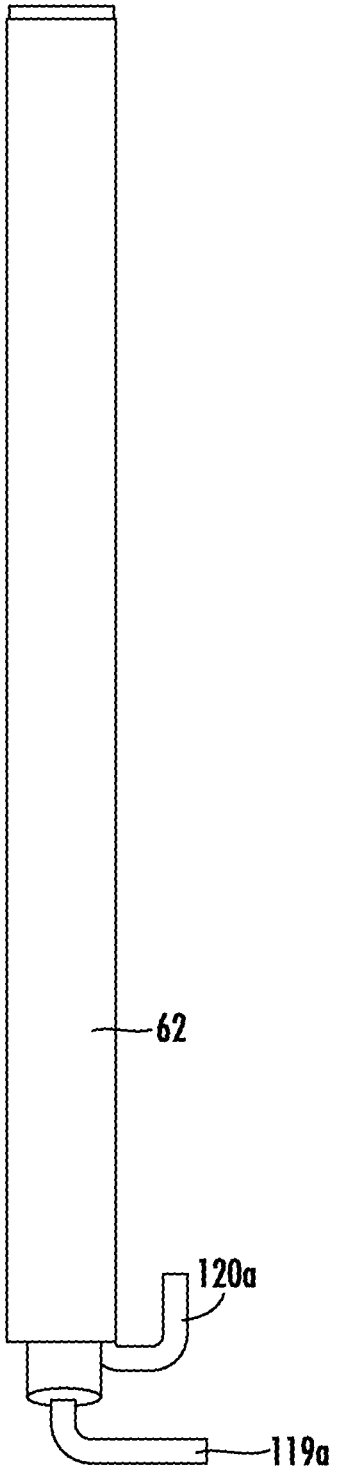
FIG. 7C is an elevated side view of a cable free end prepared for termination.
Figure 7D:
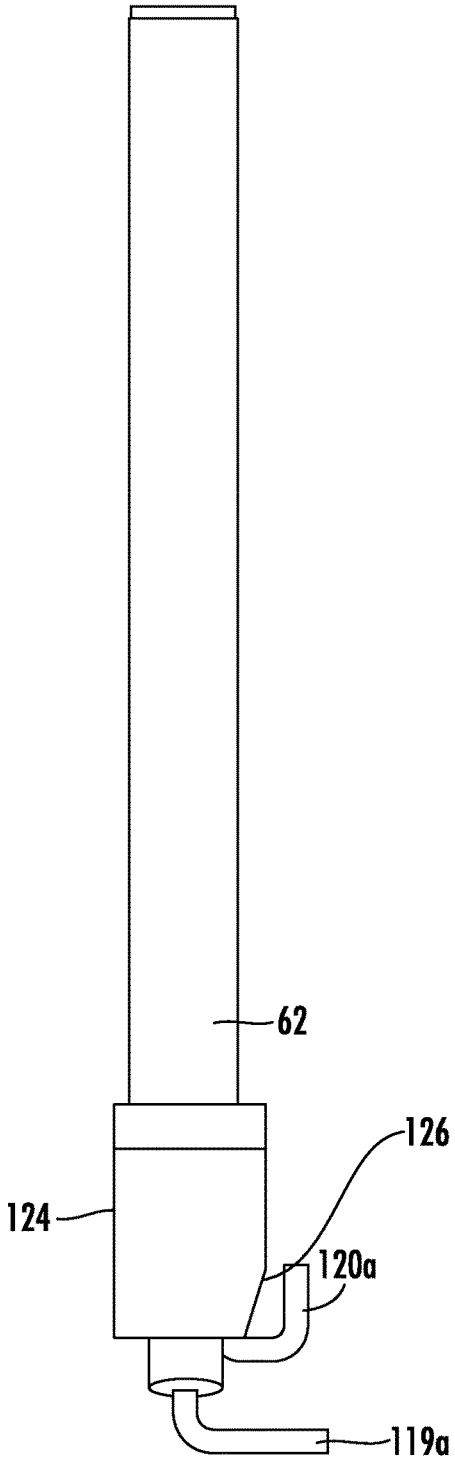
FIG. 7D is the same view as FIG. 7C but with the cable spacer in place.
Figure 7E:
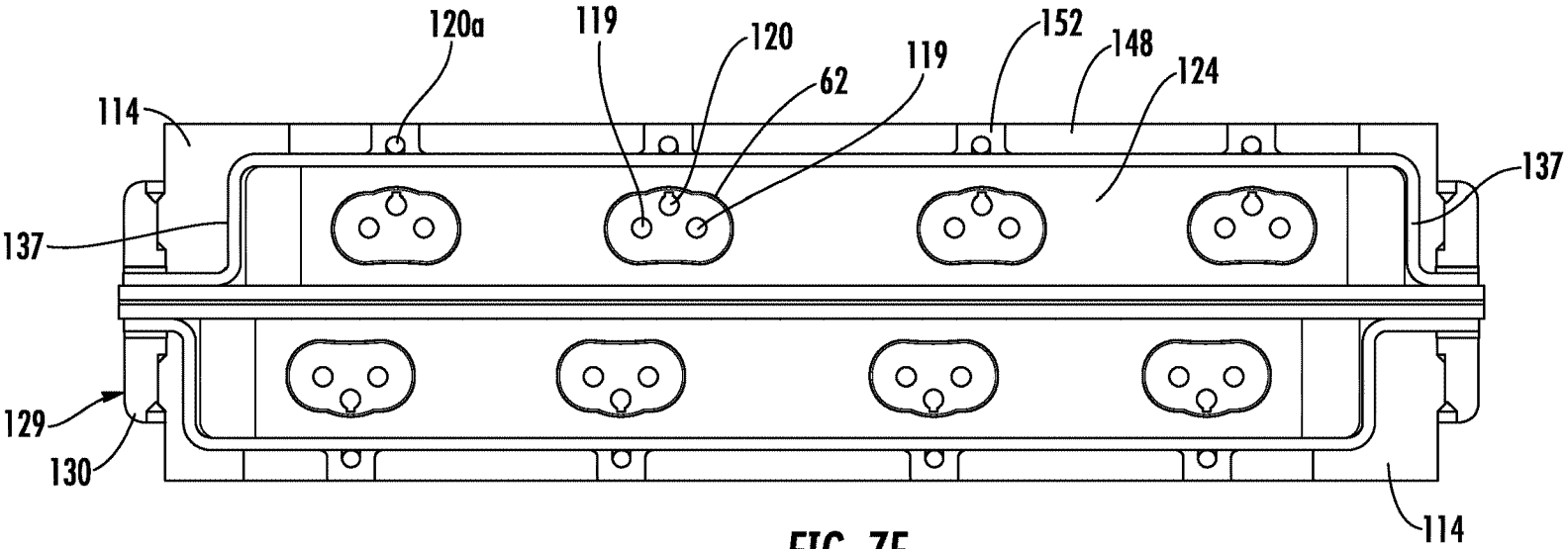
FIG. 7E is a top plane view of the cable connector depicted in FIG. 6.

The cables 62 are held in a spaced apart relationship by a spacer 124, which can be formed of an insulative material, and can be in the form of a lengthwise bar. The spacer 124 has a series of shoulder portions 126 also spaced apart in the lengthwise direction. These shoulder portions 126 are preferably aligned with the cables 62 as shown in FIGS. 6A & 6C. The shoulder portions 126 taper vertically inwardly toward the top flange 112 as illustrated in FIGS. 5C, 5D and 7C and define surfaces against which some of the ground collar tails may extend.

The spacer 124 further includes scallop-shaped recesses 128 that are located between the shoulder portions 126 and the ends of the spacer 124. The recesses 128 accommodate portions of the tails when they are bent inwardly as shown in FIGS. 5C & 5D. The spacers 124 are mounted to the carrier 110, preferably along the top flange 112 thereof in a fashion such that the ends of the cables 62 are disposed above the base flange 114. (FIG. 6C).) However, the free ends 119*a* of the signal conductors 119 extend downward and outwardly so that they align with and contact the signal terminals 132*a* of the sub-connector 129.

Figure 5D:
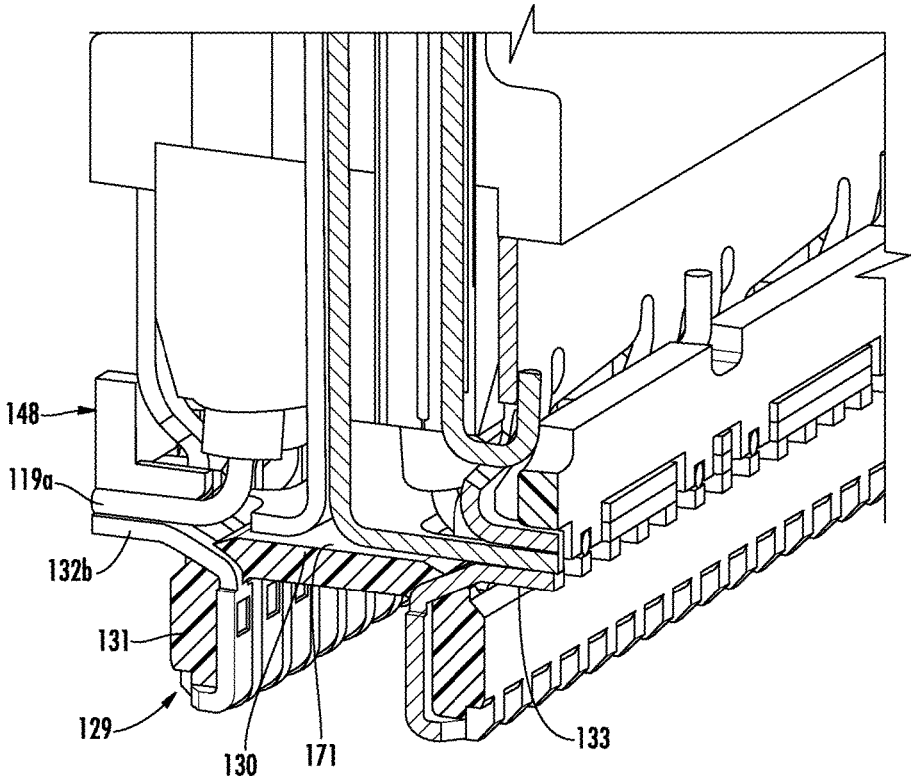
FIG. 5D is a vertical sectional view taken along lines D-D of the assembly of FIG. 5.
Figure 5E:
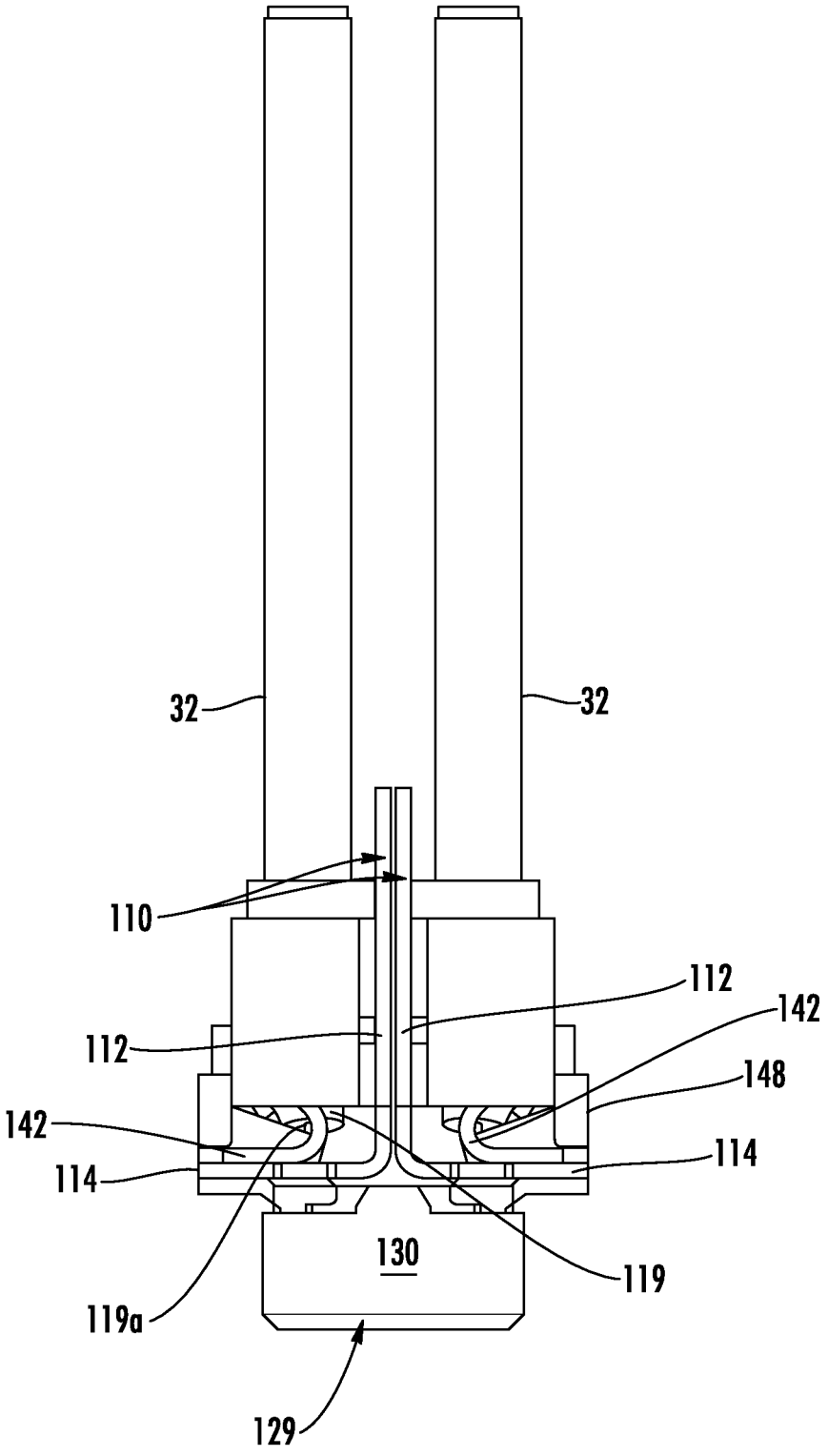
FIG. 5E is an elevational side view of the assembly of FIG. 5, taken along lines E-E thereof.

As can be appreciated from FIG. 5D, the terminals 132 have a termination portion 133 that extends outwardly and the termination portion 133 can be aligned with the free end 119*a* and can be aligned with mounting feet 117 or mounting feet 118 and tabs 140, 142 and 146. Thus, there can be two layers or three layers of conductive material aligned at the termination portion 133. One the features are aligned they can be connected together by welding. For example, a laser can be used to spot weld the two or three layers together.

In order to provide additional shielding to the cables 62 near the proximal ends 84 thereof, a ground collar 134 formed of a conductive material can be provided for each carrier 110. The depicted ground collars 134 have general U-shaped configurations with a lengthwise body 136 having two attachment flanges 137 at opposite ends of the body 136. The attachment flanges 137 attach to the top flange 112 near the ends of the cable connector 105. The ground collar body 136 and attachment flanges 137 cooperate with the top flange 112 to provide a conductive structure that can completely encircle the cable proximal ends as a group.

The ground collars 134 also have additional structure of importance. It can be seen that the ground collar 134 has a series of tails 138 and slots 139. The tails 138 extend downward to contact the base flange 114. They also, as illustrated in FIGS. 5C, 5D & 6D extend inwardly toward the centerline of the cable connector 105 and then outwardly in the widthwise direction. The tails 138 are of three distinct types. First tails 140 are thin and are illustrated as located near the ends of the cable connector 105. (FIG. 6D.) It can be seen that the bottom surfaces of these first tails 140 make contact or are positioned adjacent the upper surfaces of the base flange 114. The first tails 140 will not only contact opposing surfaces of the base flange 114, but they will also provide additional metal in the termination area which will increase the capacitance to thereby tailor the impedance in that area.

Second tails 142 are shown as wider than the first tails 140 (FIG. 6D) and have a tapered neck portion 143 that tapers down in its width along its downward extent. The tips of these second tails 142 also contact the base flange 114. The second tail 142 are align with each cable 62 so that the tails 142 may contact the base flange 114 at contact surfaces aligned between the cable signal conductor free ends 119*a*. The cable ground conductor free ends 120*b* pass through openings 144 disposed in the ground collar second tails 142 and are bent upwardly as illustrated in FIGS. 5D & 6D. In this manner, the ground conductor free ends 120*b* contact the ground collar 134 and extend vertically upwardly along the exterior surface of the ground collar 134. Lastly, third tails 146 are preferably provided and they can be seen in FIG. 6D to be wider than the first and second tails 140, 142. The third tails 146 are located on the ground collar in locations between the signal pairs of the cables 62, or in other words, aligned with the spaces which occur lengthwise between the cables 62.

The ends of the tails 138 may be considered as contact ends, and the ends of the third tails 146 are also wider than the tip portions of the first and second tails 140, 142 as illustrated in FIGS. 5C & 5D. They oppose and contact corresponding wide portions of the top flange 112. Those particular portions of the top flange are depicted as extending across three ground terminals 132*b* of the sub-connector 129 but could be limited as desired. The mounting feet 118 and the ground collar terminal tails are connected (the connection can be done with laser welding) at their contact areas to form double thickness ground connections. When the ground terminals 132*b* of the sub-connector 129 are considered, they form triple thickness ground connections and provide beneficial ground commoning while also allowing for modification of the capacitance, as is known in the art. The intervening mounting feet 117 of the base flange 114 are disposed in the flange slots 116 between the signal conductor free ends 119*a* so that they contact opposing corresponding ground terminals of the sub-connector 129. In this manner, a pinout for the board-to-board connector of the chip package substrate as shown in FIG. 5D of (reading from right to left) G-S-G-S-G-S-G-S-G-G-G-S-G-S-G-S-G-S-G-G for the twenty terminals on one side of the board connector. The same pattern can be maintained on the other side of the connector except the pattern can be offset if desired. It should be noted that while four pairs of signal terminals are shown in FIG. 6D, additional signal terminals can be readily added by increasing the number of cables connected in a row (and lengthening the components that form the cable connector 105).

Figure 8:
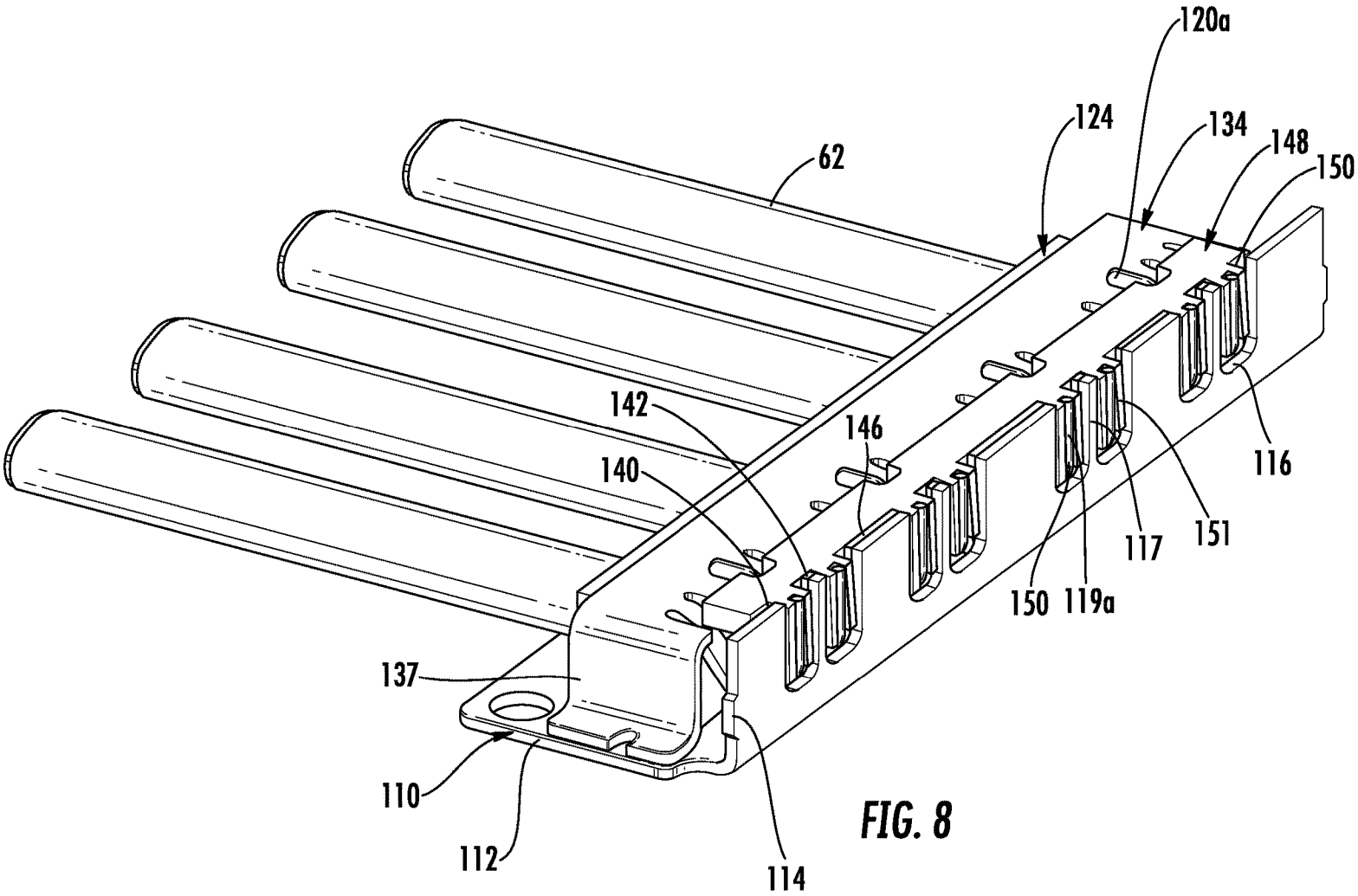
FIG. 8 is a perspective view of one of the cable carriers of the cable connector depicted in FIG. 6.
Figure 8A:
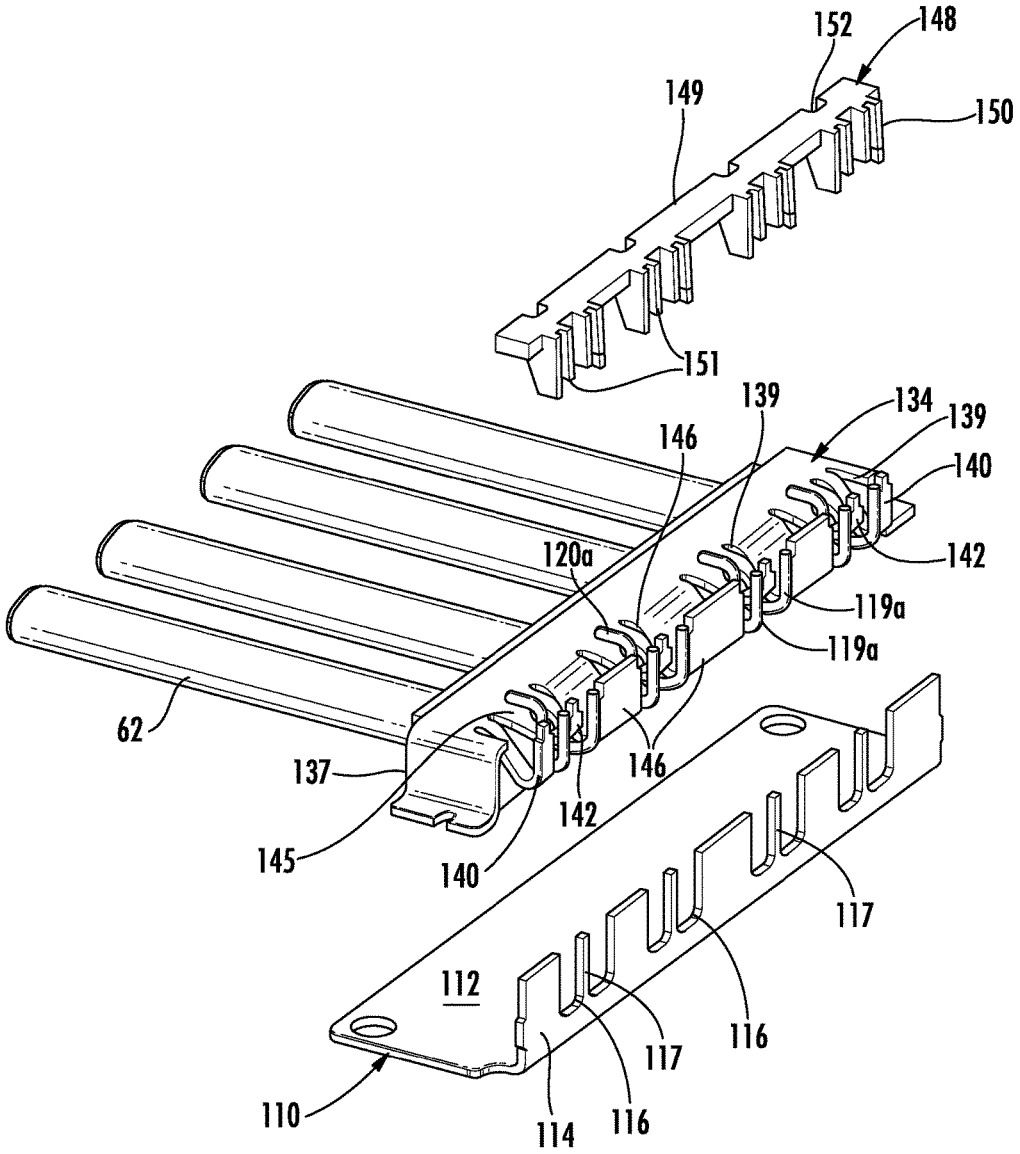
FIG. 8A is an exploded perspective view of the embodiment depicted in FIG. 8.
Figure 8B:
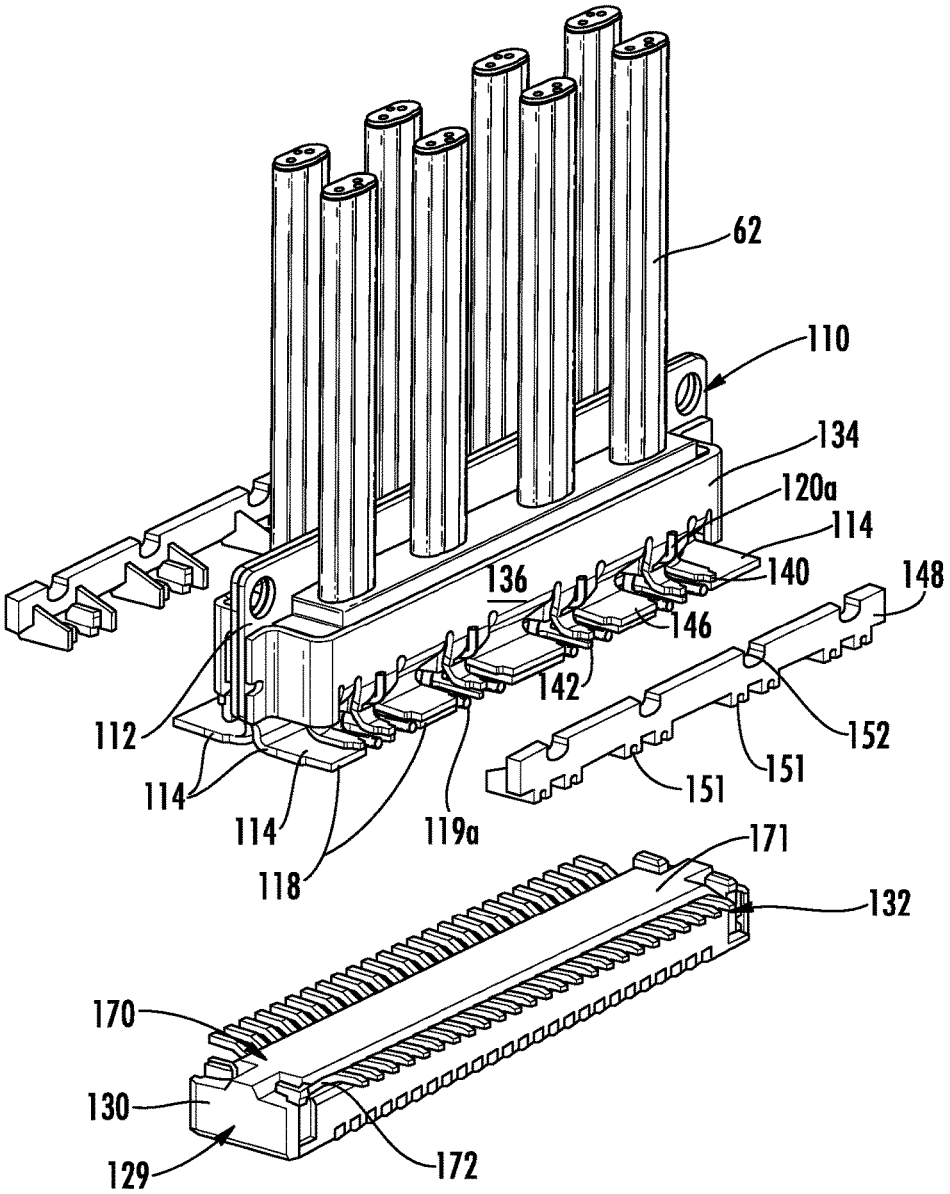
FIG. 8B is a perspective view of the cable connector of FIG. 6 with the carrier removed from a sub-connector and the wire combs spaced apart for clarity.
Figure 8C:
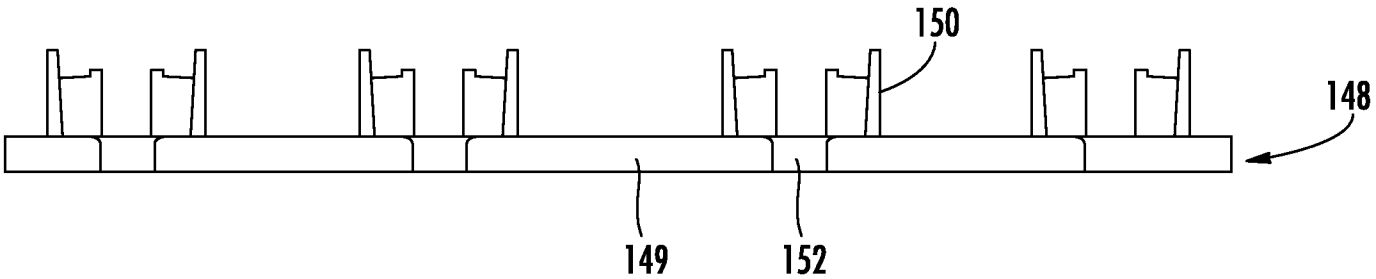
FIG. 8C is a top plan view of the wire comb depicted in FIG. 8B.
Figure 8D:
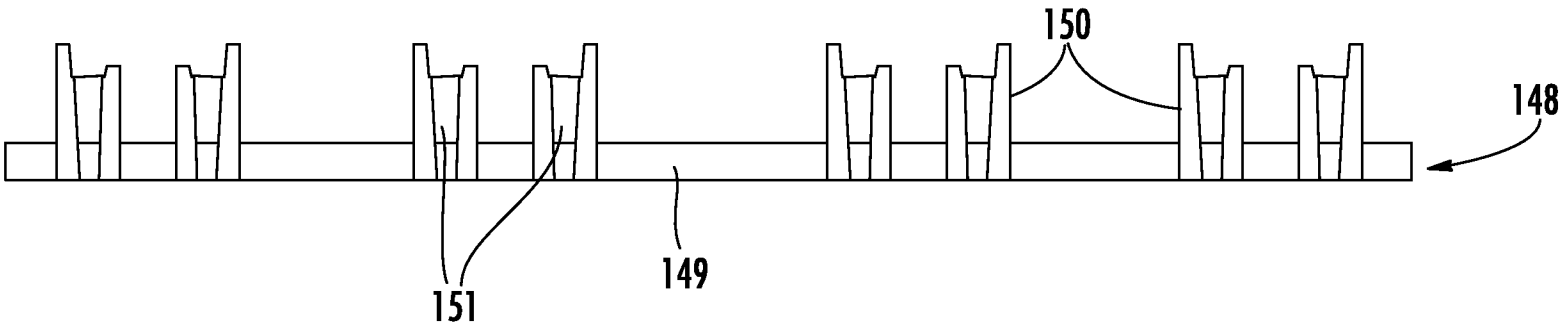
FIG. 8D is a bottom plan view of the wire comb of FIG. 8C

FIGS. 8B-8D illustrate a wire comb 148 that can be formed of insulative material and that extends lengthwise along the carrier 110. The wire comb 148 has a body portion 149 with multiple legs 150 that extend from it in a widthwise direction and the legs have slots 151 that accommodate the signal conductor free ends 119*a*. The body portion 149 also has recesses on its top through which a portion of the ground conductor free ends 120*a* extend so that when the wire comb 148 is positioned no contact is made between the two elements that would compromise the integrity of the cable connector 105.

Figure 9:
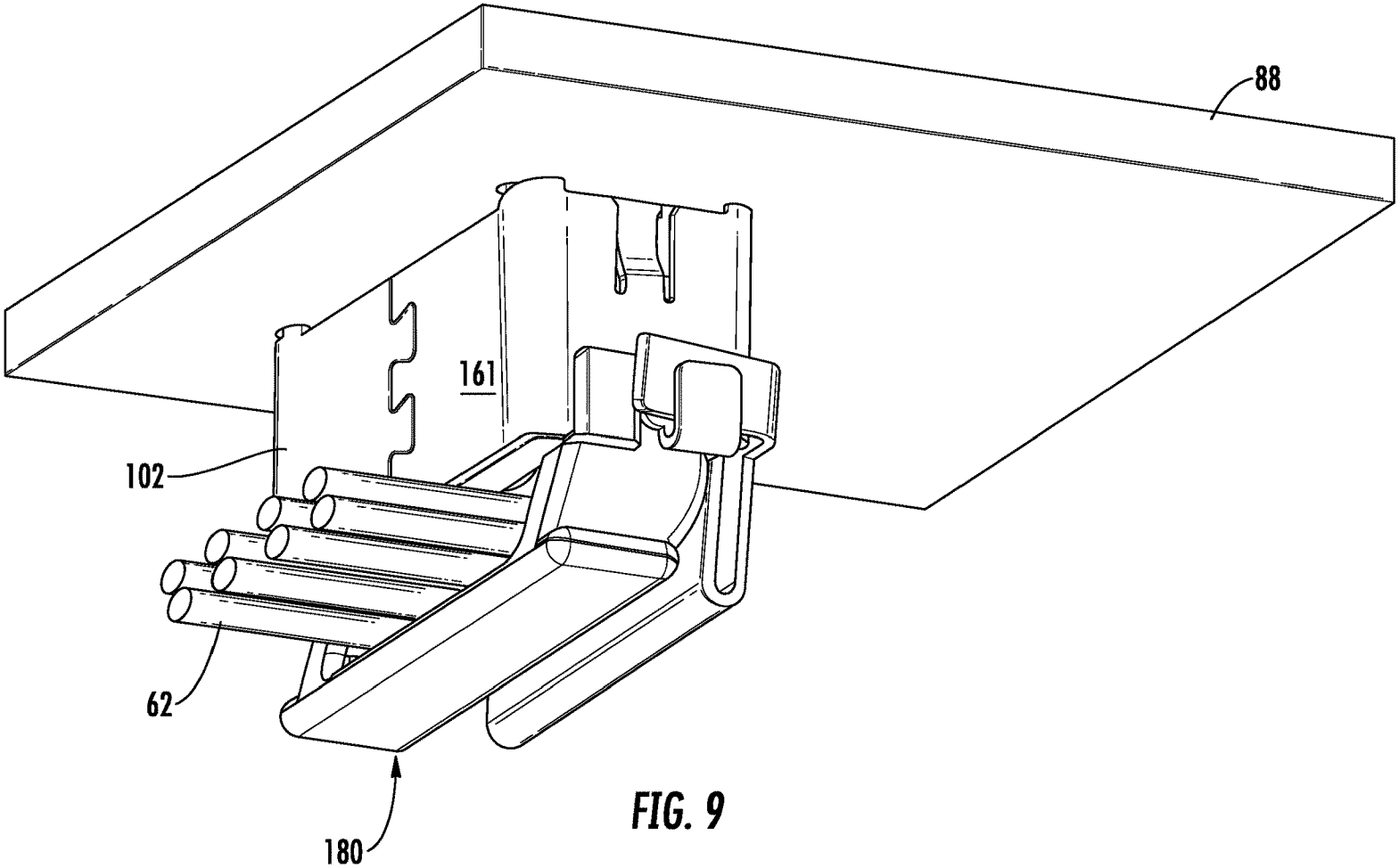
FIG. 9 is a perspective view of a connector assembly similar to that shown in FIG. 4 but with a cable connector having a right angle style; and, FIG. 9A is a partially exploded view of the connector assembly of FIG. 9.
Figure 9A:
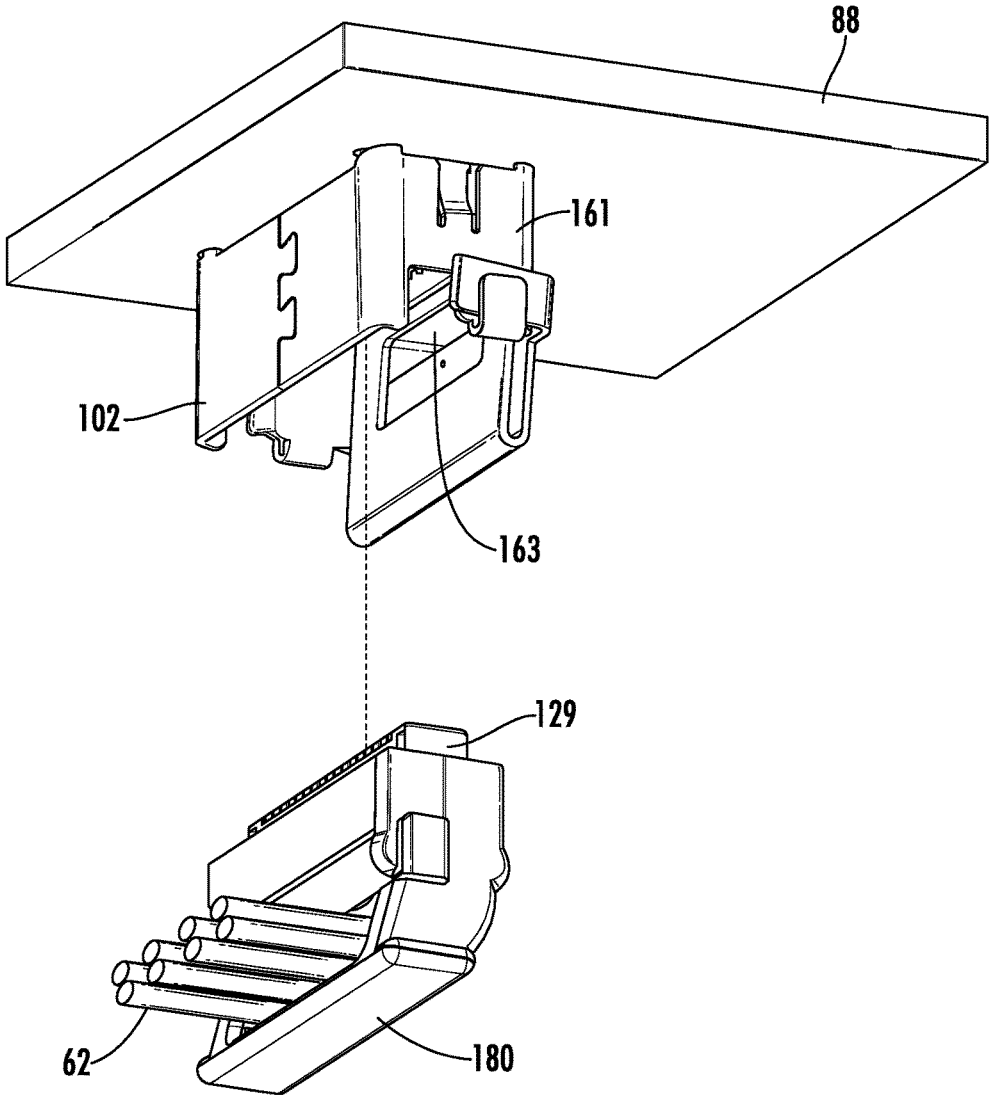

FIGS. 9 and 9A illustrate another embodiment of a cable connector 180 of the present disclosure in which the cables 62 exit the assembly at a right angle compared to a mating direction. The present disclosure utilizes structure to match the cable mating aspect of the assembly to the low profile of the board-to-board connectors to maintain an overall reduced size of the assembly so that it may fit in the opening 76 of the tray 75 and not increase the size of the tray assembly. Heights of about 7-8 mm (about 0.28 inches) are contemplated with footprints of about 6 by 14 mm and it is expected that chip packages and/or their circuit board could accommodate such a footprint.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A cable connector assembly, comprising:

a plurality of cables, each cable having a twin-ax construction with a pair of signal conductors that forms a differential pair; and a cable connector mounted on the end of the plurality of cables, the cable connector including a carrier with a top flange and a bottom flange, a spacer that supports the plurality of cables, a ground collar that is connected to the carrier so that the spacer is supported by the ground collar and the carrier on two sides, and a sub-connector with a sub-housing that supports a row of terminals, each of the terminals in the row of terminals having a termination portion that extends outwardly, wherein free ends of the signal conductors are welded to respective termination portions of corresponding terminals and the ground collar, bottom flange and termination portions of respective terminals are welded together.

2. The cable connector assembly of claim 1, wherein the cables exit from the cable connector at a right angle compared to a mating direction of the cable connector assembly.

3. The cable connector assembly of claim 1, further comprising a housing that substantially encloses the carrier and the sub-connector.

4. The cable connector assembly of claim 3, further comprising a wire comb that helps secure the signal conductors in position.

5. The cable connector assembly of claim 1, wherein the ground collar includes tails that are aligned with mounting feet provided on the bottom flange and the tails and mounting feet are aligned with the termination portions so that a three-layer connection is formed.

6. The cable connector assembly of claim 5, wherein the ground collar includes a first tail, a second tail and a third tail, wherein the second tail is wider than the first tail and the third tail is wider than the second tail and the third tail extends across at least two terminals.

7. The cable connector assembly of claim 5, wherein the ground collar includes a first tail, a second tail and a third tail, the second tail being aligned between two signal conductors that form the differential pair so as to engage a termination portion of a terminal positioned between two terminals that form a signal pair.

8. The cable connector assembly of claim 7, wherein the third tail and the corresponding mounting foot extends across three terminals and both are welded to each of the three terminals.

9. A cable connector assembly, comprising:

a plurality of cables, each cable having a twin-ax construction with a pair of signal conductors that forms a differential pair and a drain wire; and a cable connector mounted on the end of the plurality of cables, the cable connector including a carrier with a top flange and a bottom flange, a spacer that supports the plurality of cables, a ground collar that is connected to the carrier so that the spacer is supported by the ground collar and the carrier on two sides, and a sub-connector with a sub-housing that supports a row of terminals, each of the terminals in the row of terminals having a termination portion that extends outwardly, wherein free ends of the signal conductors are welded to the termination portion and the drain wire is connected to the ground collar and the ground collar, bottom flange and termination portions of respective terminals are welded together.

10. The cable connector assembly of claim 9, wherein the cables exit from the cable connector at a right angle compared to a mating direction of the cable connector assembly.

11. The cable connector assembly of claim 9, wherein the ground collar includes tails that are aligned with mounting feet provided on the bottom flange and the tails and mounting feet are aligned with the termination portions so that a three-layer connection is formed.

12. The cable connector assembly of claim 11, wherein the ground collar includes a first tail, a second tail and a third tail, wherein the second tail is wider than the first tail and the third tail is wider than the second tail and the third tail extends across at least two terminals.

13. The cable connector assembly of claim 11, wherein the ground collar includes a first tail, a second tail and a third tail, the second tail being connected to the drain wire and aligned between two signal conductors that form the differential pair so as to engage a termination portion of a terminal positioned between two terminals that form a signal pair.

14. The cable connector assembly of claim 13, wherein the second tail includes an opening and a free end of the drain wire extends through the opening and is connected to the ground collar.

* * * * *